US009795013B2

(12) United States Patent
Cho et al.

(10) Patent No.: US 9,795,013 B2
(45) **Date of Patent: *Oct. 17, 2017**

(54) WIRELESS LIGHTING CONTROL

(71) Applicant: Cooper Technologies Company, Houston, TX (US)

(72) Inventors: Nam Chin Cho, Peachtree City, GA (US); Ryan Lamon Cunningham, Fayetteville, GA (US)

(73) Assignee: Cooper Technologies Company, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/595,635

(22) Filed: May 15, 2017

(65) Prior Publication Data

US 2017/0251539 A1 Aug. 31, 2017

Related U.S. Application Data

(63) Continuation of application No. 14/671,774, filed on Mar. 27, 2015, now Pat. No. 9,655,213.

(51) Int. Cl.

| | |
|---|---|
| ***H05B 37/02*** | (2006.01) |
| ***G08C 17/00*** | (2006.01) |
| ***H05B 37/03*** | (2006.01) |

(52) U.S. Cl.

CPC ..... *H05B 37/0254* (2013.01); *G08C 17/00* (2013.01); *H05B 37/0272* (2013.01); *H05B 37/034* (2013.01); *G08C 2201/30* (2013.01)

(58) Field of Classification Search

CPC ..... H05B 33/0803; H05B 37/0272; H05B 33/0854; H05B 37/03; H05B 33/0872; H05B 33/0857; H05B 37/0227; H05B 37/0263; H05B 41/3921; F21V 23/02; F21V 23/0442; F21V 23/06

USPC ..... 315/291–297, 307, 362, 369, 149–175

See application file for complete search history.

(56) References Cited

U.S. PATENT DOCUMENTS

| | | | | |
|---|---|---|---|---|
| 6,388,399 | B1 * | 5/2002 | Eckel | G01K 1/024 315/158 |
| 8,222,832 | B2 * | 7/2012 | Zheng | H05B 33/0815 315/211 |
| 8,492,984 | B2 * | 7/2013 | Deurenberg | H05B 33/0845 315/209 R |
| 8,643,304 | B2 * | 2/2014 | Hamel | H05B 37/0254 315/291 |

(Continued)

OTHER PUBLICATIONS

International Search Report for application No. PCT/US2016/024006 dated Jun. 30, 2016.

*Primary Examiner* — Alexander H Taningco
*Assistant Examiner* — Renan Luque
(74) *Attorney, Agent, or Firm* — King & Spalding LLP

(57) ABSTRACT

A modular wireless lighting control device includes a wireless interface device that includes a wireless transceiver, a first controller, and a power supply. The wireless transceiver is in electrical communication with the first controller. The wireless interface device receives lighting control instructions wirelessly via the wireless transceiver. The modular wireless lighting control device further includes a lighting control device in electrical communication with the wireless communication device. The lighting control device includes a second controller and control interface circuitry. The control interface circuitry is compatible with a light fixture.

20 Claims, 19 Drawing Sheets

(56) References Cited

U.S. PATENT DOCUMENTS

| | | | | |
|---|---|---|---|---|
| 8,941,304 | B2 * | 1/2015 | Goscha | H01J 61/56 315/291 |
| 2003/0209999 | A1 | 11/2003 | Hui | |
| 2006/0044152 | A1 | 3/2006 | Wang | |
| 2010/0204847 | A1 | 8/2010 | Leete | |
| 2010/0301781 | A1 | 12/2010 | Budike | |
| 2011/0184577 | A1 | 7/2011 | Ilyes | |
| 2011/0204820 | A1 | 8/2011 | Tikkanen et al. | |
| 2011/0234104 | A1 * | 9/2011 | Mishima | H05B 33/08 315/129 |
| 2012/0112654 | A1 * | 5/2012 | Choong | H05B 37/0227 315/291 |
| 2012/0139426 | A1 * | 6/2012 | Ilyes | F21V 23/02 315/152 |
| 2012/0181935 | A1 | 7/2012 | Velazquez | |
| 2013/0187552 | A1 * | 7/2013 | Frodsham | H05B 33/0845 315/152 |
| 2014/0001952 | A1 | 1/2014 | Harris | |
| 2014/0001962 | A1 | 1/2014 | Harris | |
| 2014/0028200 | A1 | 1/2014 | Van Wagoner et al. | |
| 2016/0014867 | A1 * | 1/2016 | Luk | H05B 37/02 315/294 |

* cited by examiner

WIRELESS LIGHTING CONTROL

CROSS REFERENCE TO RELATED APPLICATIONS

The present application claims priority to U.S. Non-provisional patent application Ser. No. 14/671,774, filed Mar. 27, 2015 and titled "Modular Wireless Lighting Control," the entire content of which is incorporated herein by reference.

TECHNICAL FIELD

The present disclosure relates generally to lighting solutions, and more particularly to a modular wireless light control for light fixtures that lack wireless control capability.

BACKGROUND

A light fixture may include or may be connected to a driver that provides power to the light source of the light fixture. For example, the driver may be a 0 to 10 volt driver, a DALI (digitally addressable lighting interface) driver, a cut-phase driver, etc. In some cases, it may be desirable to have a light fixture that can be controlled wirelessly. For example, the capability to wirelessly turn on and off the light source of the light fixture and change the dimming level of the light source may be desirable. When an existing light fixture is not equipped with wireless control capability, an option is to replace the light fixture with a wireless control capable light fixture. Another option is to replace the light source with a lighting module that has a light source with dedicated electronics for wireless capability.

Both replacement of a light fixture and replacement of a light source with a wireless capable lighting module may be undesirable options because of cost and/or other reasons such as inconvenience of installation. Thus, a solution that allows for adding wireless control capability to an existing light fixture or a group of light fixtures may be desirable.

SUMMARY

The present disclosure relates generally to lighting solutions. In an example embodiment, a modular wireless lighting control device includes a wireless interface device that includes a wireless transceiver, a first controller, and a power supply. The wireless transceiver is in electrical communication with the first controller. The wireless interface device receives lighting control instructions wirelessly via the wireless transceiver. The modular wireless lighting control device further includes a lighting control device in electrical communication with the wireless communication device. The lighting control device includes a second controller and control interface circuitry. The control interface circuitry is compatible with a light fixture.

In another example embodiment, a modular wireless lighting control device includes a wireless interface device that includes a wireless transceiver, a first controller, and a power supply. The wireless transceiver is in electrical communication with the first controller. The wireless interface device receives lighting control instructions wirelessly via the wireless transceiver. The modular wireless lighting control device further includes a lighting control device in electrical communication with the wireless communication device. The lighting control device includes a second controller, first control interface circuitry, and second control interface circuitry. The first control interface circuitry is compatible with a first type of light fixture that has a first dimming method. The second control interface circuitry is compatible with a second type of light fixture driver that has a second dimming method.

In another example embodiment, a lighting system includes a light fixture that includes a driver and a light source. The driver is coupled to the light source. The lighting system further includes a modular wireless lighting control device coupled to the lighting fixture. The modular wireless lighting control device includes a wireless interface device. The wireless interface device includes a wireless transceiver, a first controller, and a power supply. The wireless transceiver is in electrical communication with the first controller. The wireless interface device receives lighting control instructions wirelessly via the wireless transceiver. The modular wireless lighting control device further includes a lighting control device in electrical communication with the wireless communication device. The lighting control device includes a second controller and control interface circuitry. The control interface circuitry is compatible with the driver of the light fixture. The lighting control device controls operations of the driver of the light fixture based on the lighting control instructions.

These and other aspects, objects, features, and embodiments will be apparent from the following description and the appended claims.

BRIEF DESCRIPTION OF THE FIGURES

Reference will now be made to the accompanying drawings, which are not necessarily drawn to scale, and wherein.

Figure 1A:
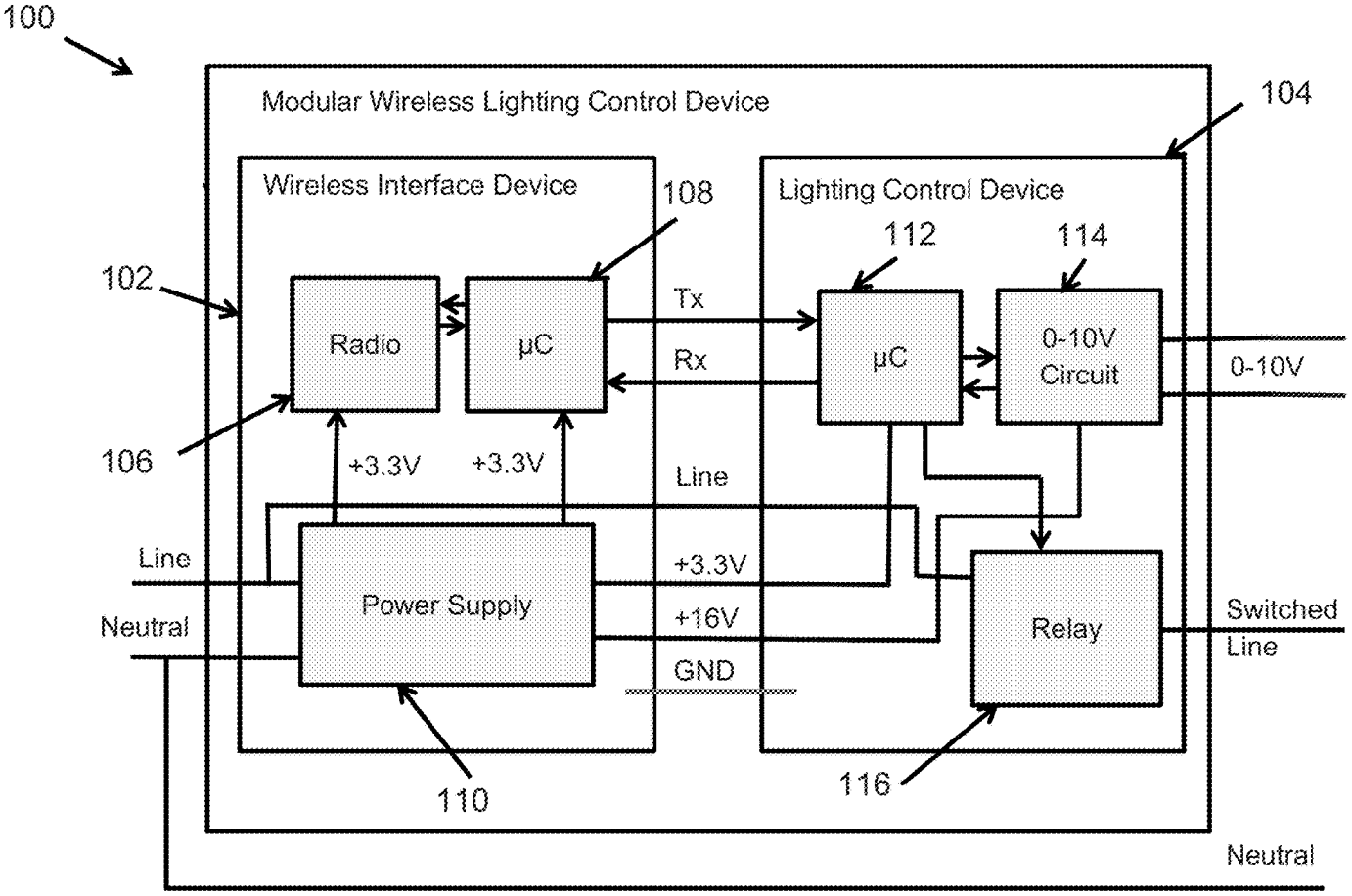
FIG. 1A illustrates a modular wireless lighting control device for use with a 0-10V driver according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, reference numerals designate like or corresponding, but not necessarily identical, elements.

DETAILED DESCRIPTION OF THE EXAMPLE EMBODIMENTS

In the following paragraphs, example embodiments will be described in further detail with reference to the figures. In the description, well known components, methods, and/or processing techniques are omitted or briefly described. Furthermore, reference to various feature(s) of the embodiments is not to suggest that all embodiments must include the referenced feature(s).

Turning now to the figures, particular embodiments are described. FIG. 1A illustrates a modular wireless lighting control device 100 for use with a 0-10V driver according to an example embodiment. In some example embodiments, the modular wireless lighting control device 100 may be coupled to a driver/ballast that provides power to a light fixture and/or allows dimming and other control over the light fixture. As illustrated in FIG. 1A, the modular wireless lighting control device 100 includes a wireless interface device 102 and a lighting control device 104 that are in electrical communication with each other.

In some example embodiments, the wireless interface device 102 includes a wireless transceiver (radio) 106, a controller 108, and power supply 110. The power supply 110 may be coupled to an input power line (Line) and may provide power to the wireless transceiver 106 and to the controller 108. For example, the power supply 110 may be coupled to a mains power via the input power line, and may generate approximately +3.3 V outputs that are provided to the wireless transceiver 106 and the controller 108. In some alternative embodiments, the power supply 110 may provide other voltages to the wireless transceiver 106 and to the controller 108. The mains supply may be a 120-volt, 60-Hertz supply.

As illustrated in FIG. 1A, the wireless transceiver 106 is in electrical communication with the controller 108. For example, the wireless transceiver 106, which may include an antenna, may wirelessly receive lighting control instructions, for example, from a wireless user device (e.g., a smart phone, tablet, etc.) and pass the instructions to the controller 108 for processing. Similarly, the controller 108 may provide information, such as status information, to the wireless transceiver 106, and the wireless transceiver 106 may wirelessly transmit the information, for example, to a wireless user device. The wireless interface device 102 may be compliant with one or more wireless standards, such as IEEE 802.11, Bluetooth, Zigbee, etc. A user application may reside on a wireless user device to communicate with the modular wireless lighting control device 100.

In some example embodiments, the wireless interface device 102 and the lighting control device 104 may communicate with each other via Tx and Rx connections. To illustrate, the controller 108 and the controller 112 may have universal asynchronous receive/transmit (UART) interfaces coupled via the Tx and Rx connections and may communicate with each other via the UART interfaces. To illustrate, the controller 108 may process instructions wirelessly received by the wireless transceiver 106 and send the instructions to the controller 112 via the Tx connection coupled to, for example, corresponding UART interfaces of the controllers 108, 112. In some example embodiments, the controller 112 may send the information (e.g., dimming level) to the controller 108 via the Rx connection coupled to, for example, other corresponding UART interfaces of the controllers 108, 112. In some example embodiments, the wireless interface device 102 and the lighting control device 104 may communicate with each other via other digital communication interfaces such as $I^2C$ and SPI.

In some example embodiments, the lighting control device 104 includes a controller 112, a 0-10V circuit 114, and a relay 116. The controller 112 and the 0-10V circuit are coupled to the power supply 110 of the wireless interface device 102. The power supply 110 provides power to the controller 112 and to the 0-10V circuit. For example, the power supply 110 may provide approximately +3.3 V to the controller 112 and approximately +16V to the 0-10V circuit. In some alternative embodiments, the power supply 110 may provide other voltages to the controller 112 and the 0-10V circuit.

In some example embodiments, the controller 112 is in electrical communication with the 0-10V circuit and the relay 116. The relay 116 is coupled to the same input power line (Line) that is coupled to the power supply 110. An output power line (Switched Line) is coupled to the relay 116, and the relay 116 may serve as a switch between the input power line and the output power line. To illustrate, when the relay 116 is switched on, the relay 116 provides the power on the input power line on the output power line. The switched power output of the relay 116 may be electrically switched on and off by the controller 112. The controller 112 may also control the output voltage level of the 0-10V circuit that is provided on the 0-10V output port of the modular wireless lighting control device 100. The 0-10V circuit 114, which is control interface circuitry of the lighting control device 104, is compatible with a 0-10V driver/ballast that is commonly used in light fixtures.

Figure 1B:
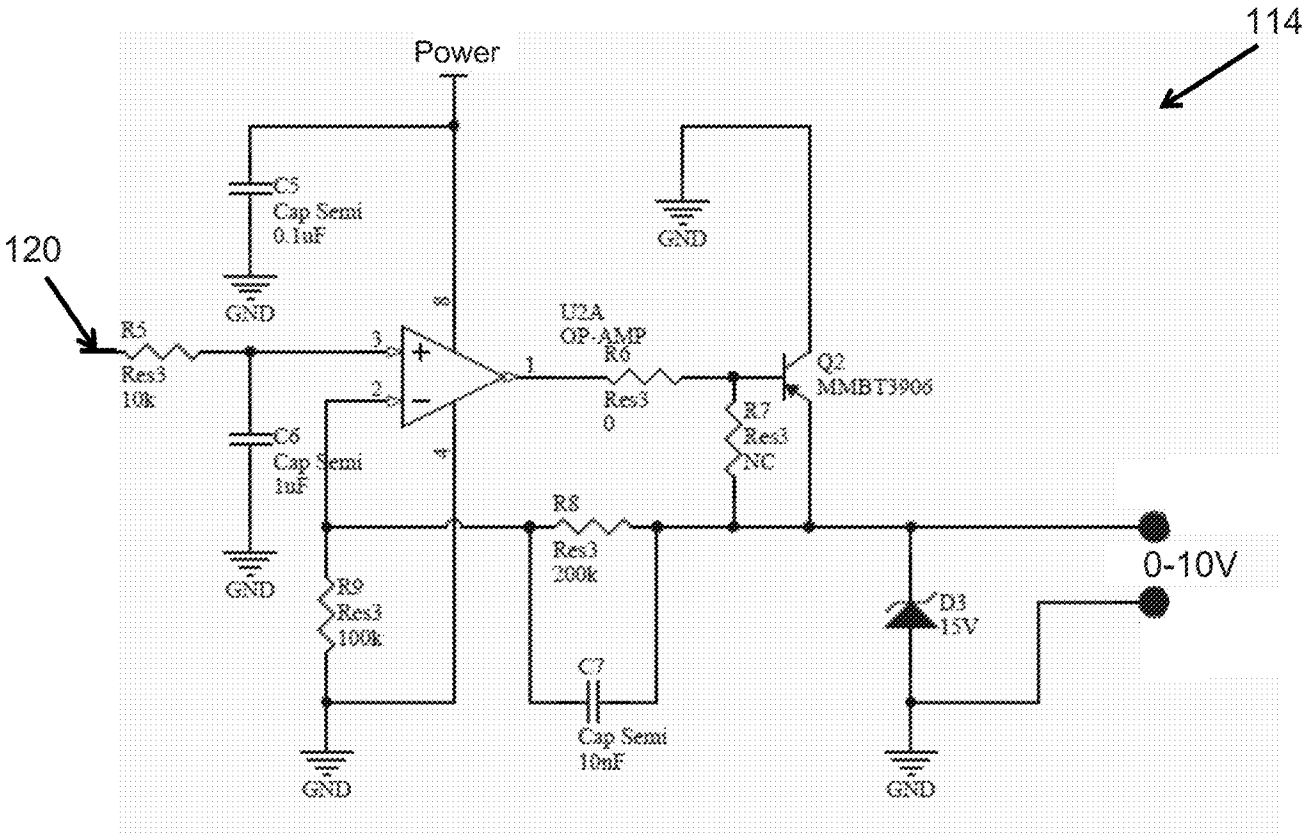
FIG. 1B illustrates a 0-10V circuit of the modular wireless lighting control device of FIG. 1A according to an example embodiment.

An example circuit schematic of the 0-10V circuit 114 of the modular wireless lighting control device 100 is shown in FIG. 1B. Referring to FIGS. 1A and 1B, the controller 112 may be coupled to the 0-10V at connection 120. For example, the controller 112 may provide a pulse-width-modulation (PWM) signal to the 0-10V circuit 114 to control the output voltage of the 0-10V circuit 114 provided on the 0-10V output port. In some alternative embodiments, the component values other than shown in FIG. 1B may be used without departing from the scope of this disclosure. Further, the 0-10V circuit 114 may include other components and circuitry than shown in FIG. 1B without departing from the scope of this disclosure.

In some example embodiments, each one of the controllers 108, 112 may be a microprocessor or microcontroller. For example, the controllers 108, 112 may be integrated circuit controllers (e.g., part number PIC16F690). Communication between the controllers 108, 112 may occur via standard communication interfaces (e.g., a data port) of the controllers 108, 112. For example, the interfaces of the controllers 108, 112 may be UART, $I^2C$, or SPI. In some alternative embodiments, one or both of the controllers 108, 112 may be implemented using multiple circuits and components, in an FPGA, as an ASIC, or a combination thereof. In some example embodiments, the controllers 108, 112 may include one or more memory devices for storing code that may be executed by the controllers 108, 112 to perform one or more of the operations described above. The one or more memory devices may also be used to store data generated by the controllers 108, 112. Alternatively or in addition, the controller 108 may access software code and data, and store data in a memory device that is outside of the wireless interface device 102. Similarly, the controller 112 may access software code and data, and store data in a memory device that is outside of the lighting control device 104.

In some example embodiments, the modular wireless lighting control device 100 may be coupled to a dimmable 0-10V driver/ballast of a light fixture. For example, the switched power line from the relay 116 and the 0-10V output from the 0-10V circuit 114 may be coupled to the 0-10V driver/ballast of the light fixture. The controller 112 may power on and off the light fixture by turning on and off the power from the relay 116 on the switched power line (Switched Line). The controller 112 may also change the dimming level of the light fixture by changing the voltage level on the 0-10V output from the 0-10V circuit 114.

During operation, the wireless interface device 102 and the lighting control device 104 communicate with each other to control a 0-10V driver/ballast of a light fixture and to provide status and other information to a wireless user device that may be in wireless communication with the modular wireless lighting control device 100. For example, the wireless interface device 102 may wirelessly receive instructions to turn on or off, to change dimming level, etc. of a light fixture. The wireless interface device 102 may translate the instructions and provide the translated instructions to the lighting control device 104 via the Tx connection (e.g., UART connection). For example, the controller 108 may translate the instructions received by the wireless transceiver 106 via a wireless network (e.g., Wi-Fi, Zigbee, Bluetooth, etc.) into a format usable by the controller 108. To illustrate, the controller 108 may extract instruction byte(s) from a wireless signal received by the wireless transceiver 106 and provide the instruction byte(s) to the controller 112 via the Tx connection. The wireless network may be based on any new wireless protocol or standard that is adopted for lighting controls, IoT, or others.

In some example embodiments, the controller 112 may process instructions received from the wireless interface device 102 to control a 0-10V driver/ballast of a light fixture that is attached to the modular wireless lighting control device 100. To illustrate, the controller 112 may switch on or off the relay 116 based on the received instructions to turn power on and off on the output power line (Switched Line) that is coupled to a 0-10V driver/ballast of the light fixture. The controller 112 may also change the voltage level on the 0-10V output of the 0-10V circuit 114 based on the received instructions to control the dimming level of the 0-10V driver/ballast of the light fixture. For example, the instruction provided to the controller 112 may be to step up or down a dimming level of the light fixture (i.e., the 0-10V driver/ballast), to set the current output of the 0-10V driver/ballast to a percentage of the maximum current output of the 0-10V driver/ballast, or to set the current output of the 0-10V driver/ballast to a particular amount (e.g., in milliamps), or to set the dimming level to a maximum or minimum dimming setting of the 0-10V driver/ballast.

In some example embodiments, the instructions wirelessly received by the wireless transceiver 106 may be directed to the modular wireless lighting control device 100. For example, the wireless interface device 102 may receive instructions to configure or over-ride some parameters (e.g., register values) of the wireless interface device 102 or the lighting control device 104. The wireless interface device 102 may also wirelessly receive a request (i.e., instructions that request) to provide status information of the modular wireless lighting control device 100. For example, the wireless interface device 102 may receive requests to provide dimming level setting, power on/off setting, etc. To respond to a request to provide status information, the wireless interface device 102 may, for example, request the information from the lighting control device 104 via the Tx connection, receive the information via the Rx connection, and wirelessly transmit the information, for example, to a wireless user device. In some example embodiments, the instructions received by the wireless interface device 102 may be to reset (e.g., power cycle) the lighting control device 104. In general, the wireless interface device 102 may wirelessly receive instructions related to the configuration and operation of the modular wireless lighting control device 100.

In some example embodiments, the wireless interface device 102 may query the lighting control device 104 to determine the identity of the lighting control device 104. For example, at power up, the wireless interface device 102 may query the lighting control device 104 to determine whether the lighting control device 104 is compatible with 0-10V driver/ballast or with another type of driver/ballast. To illustrate, the wireless interface device 102 may query the lighting control device 104 via the Tx connection and receive the response via the Rx connection.

By adding the modular wireless lighting control device 100 to a light fixture that has a 0-10V driver/ballast, the modular wireless lighting control device 100 may be used to add wireless control capability to the light fixture. By adding the wireless control capability to a light fixture, more costly replacement of the entire light fixture or the light source of the light fixture with a wireless capable lighting module may be avoided. In some example embodiments, the modular wireless lighting control device 100 may be added to a light fixture during the manufacturing/assembly of the light fixture. Alternatively, the modular wireless lighting control device 100 may be added to the light fixture by an end user.

In FIG. 1A, some connections between different components of the modular wireless lighting control device 100 are omitted for clarity of illustration. Further, single connections shown in FIG. 1A may represent single or multiple electrical connections (e.g., wires) as would be understood by a person of ordinary skill in the art. For clarity of illustration, not all components of the modular wireless lighting control device 100 are shown in FIG. 1A. Further, in some example embodiments, some components of the wireless interface device 102 may be integrated into a single component. Similarly, some components of the lighting control device 104 may be integrated into a single component. In general but not exclusively, arrows in FIG. 1A may indicate directions of communication and directions of power supply. Voltage level shown in FIG. 1A are for illustration, and in some example embodiments, other voltage levels may be used without departing from the scope of this disclosure.

Figure 2:
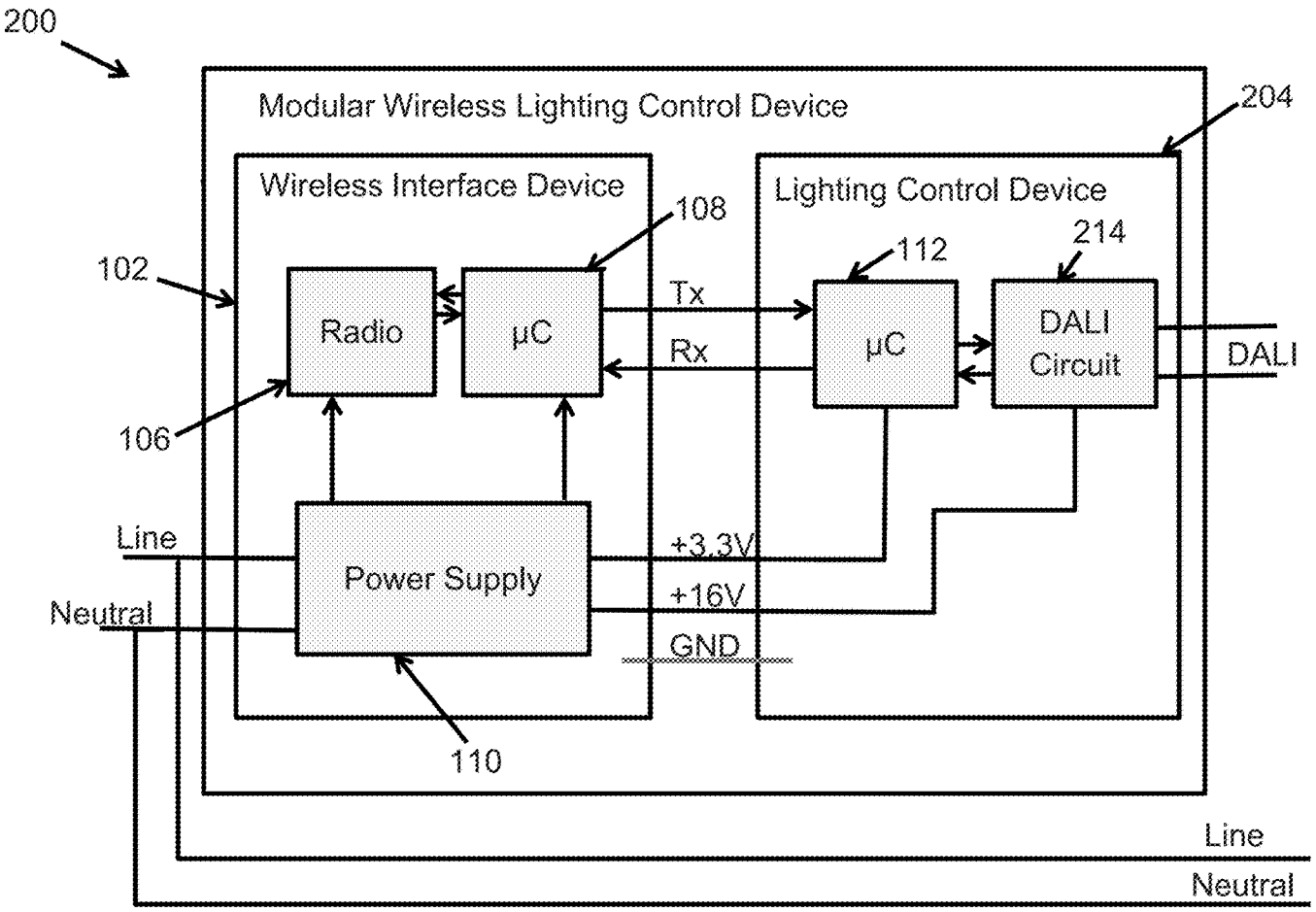
FIG. 2 illustrates a modular wireless lighting control device for use with a DALI driver according to an example embodiment.

FIG. 2 illustrates a modular wireless lighting control device 200 for use with a DALI driver according to an example embodiment. In some example embodiments, the modular wireless lighting control device 200 may be coupled to a driver/ballast that provides power to a light fixture and/or allows dimming and other control over the light fixture. For the sake of brevity, descriptions of some elements of the modular wireless lighting control device 200 that are described are omitted here. As illustrated in FIG. 2, the modular wireless lighting control device 200 include the wireless interface device 102 and a lighting control device 204. The wireless interface device 102 is substantially the same wireless interface device 102 of FIG. 1A.

The lighting control device 204 may include the controller 112 and a DALI circuit 214. The controller 112 is substantially the same controller 112 of FIG. 1A. As illustrated in FIG. 2, the power supply 110 of the wireless interface device 102 provides power (e.g., +3.3 V) to the controller 112. The power supply 110 also provides power (e.g., +16V) to the DALI circuit 214. The DALI circuit 214, which is control interface circuitry of the lighting control device 204, is compatible with a DALI driver that is commonly used in light fixtures.

In some example embodiments, the controller 112 may process instructions received from the wireless interface device 102 in a similar manner as described with respect to FIG. 1A to control a DALI driver/ballast of a light fixture that is attached to the modular wireless lighting control device 200. To illustrate, in some example embodiments, the controller 112 may receive non-DALI compliant instructions from a wireless user device and translate the instruction to DALI instructions that are provided to a DALI driver of a light fixture via the DALI circuit 214. The DALI circuit 214 may serve as an interface between the controller 112 and the DALI driver. For example, the DALI circuit 214 may perform voltage level shifting and other similar tasks that enable compatibility between the modular wireless lighting control device 100 and a DALI driver. In general, the DALI instructions from the controller 112 and the DALI output of the DALI circuit 214 are compliant with the International Electrotechnical Commission (IEC) DALI standard (e.g., IEC 62386).

In some example embodiments, the controller 112 may receive DALI instructions from a wireless user device. For example, the lighting control device 204 may be configured, for example, using instructions provided through the wireless interface device 102 to operate in a pass-through mode. To illustrate, the wireless transceiver 106 of the wireless interface device 102 may wirelessly receive a signal that includes DALI instruction(s). For example, the wireless transceiver 106 may receive the signal via an IEEE 802.11, Bluetooth, or another wireless network. The transceiver 106 may pass the signal to the controller 108, and the controller 108 may extract the DALI instructions and provide the instructions to the controller 112 of the lighting control device 204. For example, the controller 108 may provide the instructions to the controller 112 via the Tx connection (e.g., a UART connection). Because DALI instructions are understood by a DALI driver of a light fixture that is attached to the modular wireless lighting control device 200, the controller 112 may transfer to the DALI driver, via the DALI circuit 214, the DALI instructions without performing a translation of the instructions.

Similar to the modular wireless lighting control device 100 FIG. 1A, the wireless interface device 102 and the lighting control device 204 may communicate with each other to provide wireless control over a DALI driver of a light fixture that is attached to the lighting control device 204. In general, instructions received by the wireless interface device 102 may be used to configure the modular wireless lighting control device 200, to request status and other information from the modular wireless lighting control device 200, and to control the DALI driver of a light fixture (e.g., change dim level) that is attached to the modular wireless lighting control device 200. In some example embodiments, dim levels and other status information may be provided to a wireless user device. In some example embodiments, the controller 112 may receive status and other information from a DALI driver via the DALI circuit 214 and provide the information to the wireless interface device 102 for wireless transmission to a wireless user device by the transceiver 106.

In some example embodiments, the wireless interface device 102 may query the lighting control device 204 to determine the identity of the lighting control device 204. For example, at power up, the wireless interface device 102 may query the lighting control device 204 to determine whether the lighting control device 104 is compatible with a DALI driver or with another type of driver/ballast. To illustrate, the wireless interface device 102 may query the lighting control device 204 via the Tx connection and receive the response via the Rx connection.

By adding the modular wireless lighting control device 200 to a light fixture that has a DALI driver, the modular wireless lighting control device 200 may be used to add wireless control capability to the light fixture. By adding the wireless control capability to a light fixture, more costly replacement of the entire light fixture or the light source of the light fixture with a wireless capable lighting module may be avoided. In some example embodiments, the modular wireless lighting control device 200 may be added to a light fixture during the manufacturing/assembly of the light fixture. Alternatively, the modular wireless lighting control device 200 may be added to the light fixture by an end user.

In FIG. 2, some connections between different components of the modular wireless lighting control device 200 are omitted for clarity of illustration. Further, single connections shown in FIG. 2 may represent single or multiple electrical connections (e.g., wires) as would be understood by a person of ordinary skill in the art. For clarity of illustration, not all components of the modular wireless lighting control device 200 are shown in FIG. 2. Further, in some example embodiments, some components of the wireless interface device 102 may be integrated into a single component. Similarly, some components of the lighting control device 204 may be integrated into a single component. In general but not exclusively, arrows in FIG. 2 may indicate directions of communication and directions of power supply. Voltage level shown in FIG. 2 are for illustration, and in some example embodiments, other voltage levels may be used without departing from the scope of this disclosure.

Figure 3:
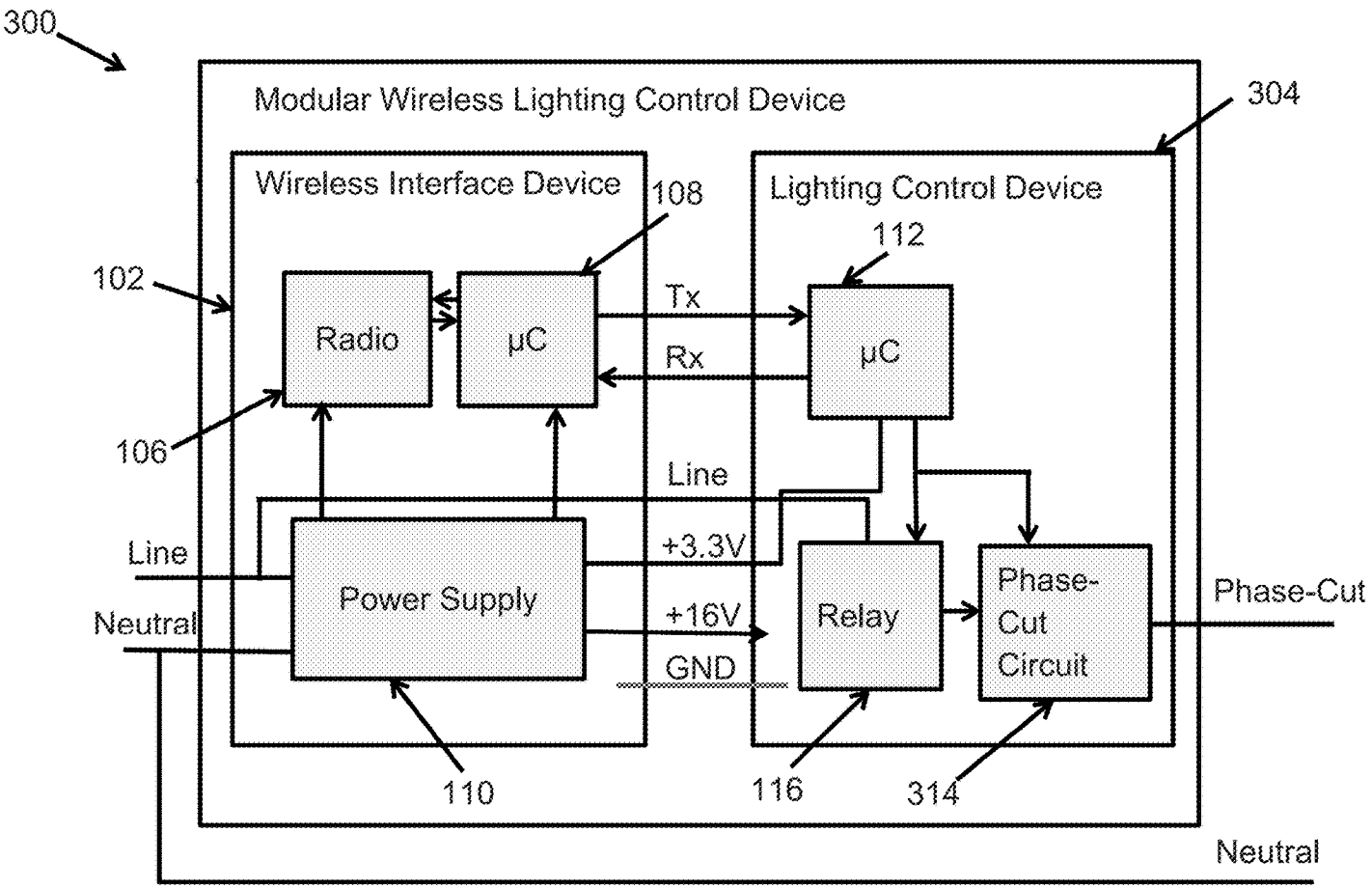
FIG. 3 illustrates a modular wireless lighting control device for use with a phase-cut driver according to an example embodiment.

FIG. 3 illustrates a modular wireless lighting control device 300 for use with a phase-cut driver according to an example embodiment. In some example embodiments, the modular wireless lighting control device 300 may be coupled to a driver/ballast that provides power to a light fixture and/or allows dimming and other control over the light fixture. For the sake of brevity, description of some elements of the modular wireless lighting control device 300 that are described above are omitted here. As illustrated in FIG. 3, the modular wireless lighting control device 300 include the wireless interface device 102 and a lighting control device 304. The wireless interface device 102 is substantially the same wireless interface device 102 of FIGS. 1A and 2.

The lighting control device 304 may include the controller 112, the relay 116, and a phase-cut circuit 314. In some example embodiments, the controller 112 is in electrical communication with the phase-cut circuit 314 and the relay 116. The controller 112 is substantially the same controller 112 of FIGS. 1A and 2. The relay 116 is also substantially the same relay 116 of FIG. 1A. As illustrated in FIG. 3, the power supply 110 of the wireless interface device 102 provides power (e.g., +3.3 V) to the controller 112.

The relay 116 may be electrically switched on and off by the controller 112. To illustrate, the relay 116 is coupled to the same input power line that is coupled to the power supply 110. An output power line of the relay 116 is coupled to the phase-cut circuit 314, and the relay 116 may serve as a switch to turn on and off power to the phase-cut circuit 314, which in turn switches the phase-cut output of the phase-cut circuit 314 on and off. The phase-cut circuit 314, which is control interface circuitry of the lighting control device 304, is compatible with a phase-cut driver that is commonly used in light fixtures.

In some example embodiments, the controller 112 may also control the output of the phase-cut circuit 314. For example, the controller 112 may control the firing angle of the phase-cut circuit 314. The firing angle may ideally range from 0 to 180 degrees. In some example embodiments, the firing angle may range between 30 and 150 degrees. The controller 212 may control the phase-cut circuit 314 (e.g., change firing angle) based on instructions that are received wirelessly by the modular wireless lighting control device 300. To illustrate, the transceiver 106 may receive a signal including one or more instructions (e.g., dim level, turn off, etc.), and the controller 108 may extract and provide the instruction(s) to the controller 112 of the lighting control device 304.

In general, the controller 112 may process instructions received from the wireless interface device 102 in a similar manner as described with respect to FIG. 1A to control a phase-cut driver of a light fixture that is attached to the modular wireless lighting control device 300. In general, the wireless interface device 102 and the lighting control device 304 may communicate with each other to provide wireless control over a phase-cut driver of a light fixture that is attached to the lighting control device 304. To illustrate, instructions received by the wireless interface device 102 may be used to configure the modular wireless lighting control device 300, to request status and other information from the modular wireless lighting control device 300, and to control (e.g., change dim level) of the phase-cut driver of a light fixture that is attached to the modular wireless lighting control device 300. In some example embodiments, dim levels and other status information may be provided by the modular wireless lighting control device 300 to a wireless user device.

In some example embodiments, the wireless interface device 102 may query the lighting control device 304 to determine the identity of the lighting control device 304. For example, at power up, the wireless interface device 102 may query the lighting control device 304 to determine whether the lighting control device 104 is compatible with a phase-cut driver or with another type of driver/ballast. To illustrate, the wireless interface device 102 may query the lighting control device 304 via the Tx connection and receive the response via the Rx connection.

By adding the modular wireless lighting control device 300 to a light fixture that has a phase-cut driver, the modular wireless lighting control device 300 may be used to add wireless control capability to the light fixture. By adding the wireless control capability to a light fixture, more costly replacement of the entire light fixture or the light source of the light fixture with a wireless capable lighting module may be avoided. In some example embodiments, the modular wireless lighting control device 300 may be added to a light fixture during the manufacturing/assembly of the light fixture. Alternatively, the modular wireless lighting control device 300 may be added to the light fixture by an end user.

In FIG. 3, some connections between different components of the modular wireless lighting control device 300 are omitted for clarity of illustration. Further, single connections shown in FIG. 3 may represent single or multiple electrical connections (e.g., wires) as would be understood by a person of ordinary skill in the art. For clarity of illustration, not all components of the modular wireless lighting control device 300 are shown in FIG. 3. Further, in some example embodiments, some components of the wireless interface device 102 may be integrated into a single component. Similarly, some components of the lighting control device 304 may be integrated into a single component. In general but not exclusively, arrows in FIG. 3 may indicate directions of communication and directions of power supply. Voltage level shown in FIG. 3 are for illustration, and in some example embodiments, other voltage levels may be used without departing from the scope of this disclosure.

Figure 4:
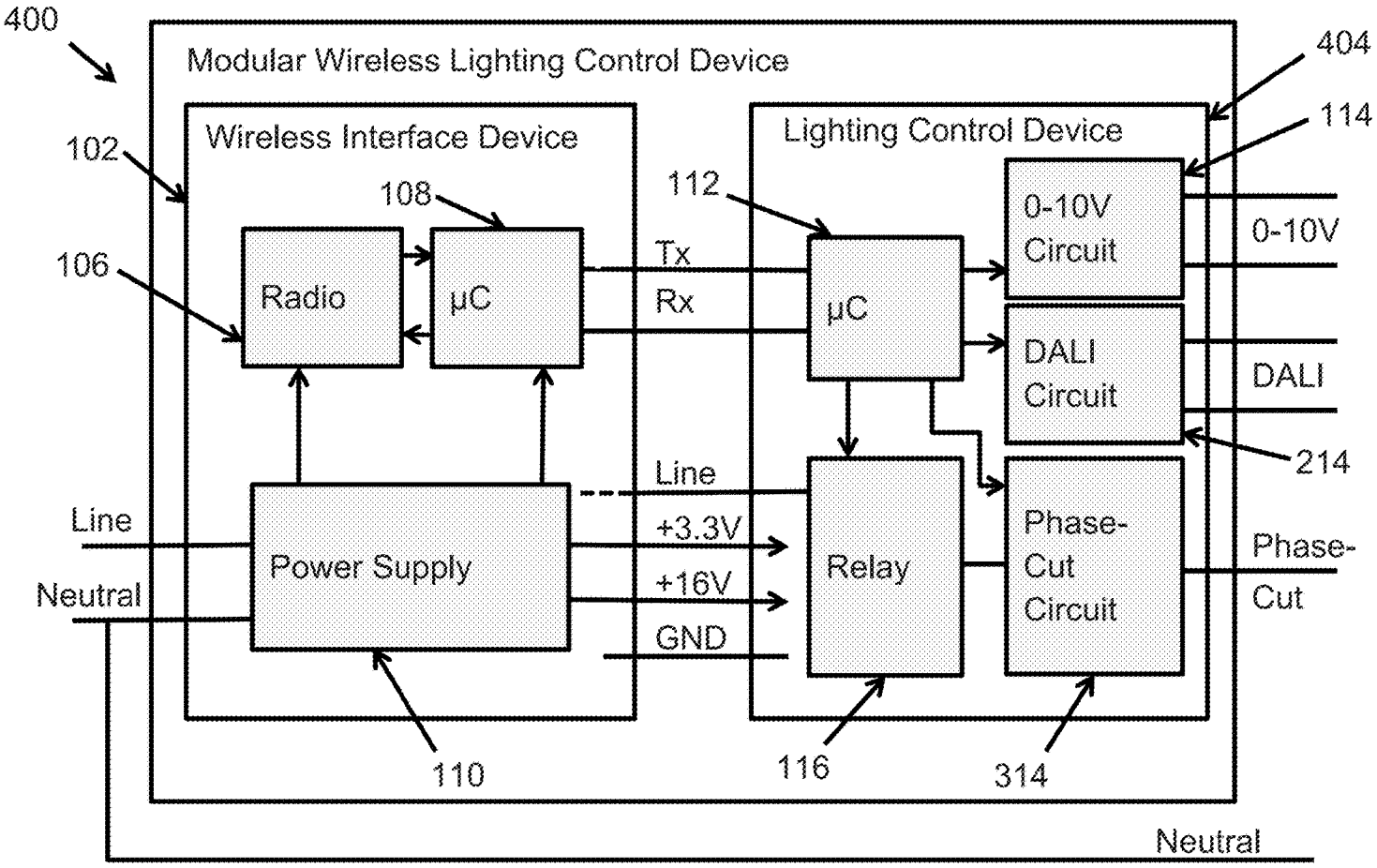
FIG. 4 illustrates a modular wireless lighting control device for use with 0-10V, DALI, and phase-cut drivers according to an example embodiment.

FIG. 4 illustrates a modular wireless lighting control device 400 for use with 0-10V, DALI, and phase-cut drivers according to an example embodiment. In some example embodiments, the modular wireless lighting control device 400 may be coupled to a driver/ballast that provides power to a light fixture and/or allows dimming and other control over the light fixture. For the sake of brevity, descriptions of some elements of the modular wireless lighting control device 400 that are described above are omitted here. As illustrated in FIG. 4, the modular wireless lighting control device 400 include the wireless interface device 102 and a lighting control device 404. The wireless interface device 102 is substantially the same wireless interface device 102 of FIGS. 1A, 2, and 3.

In some example embodiments, the lighting control device 404 includes the controller 112, the relay 116, the 0-10V circuit 114 of FIG. 1A, the DALI circuit 214 of FIG. 2, and the phase-cut circuit 314 of FIG. 3. Individually, the 0-10V circuit 114 of FIG. 1A, the DALI circuit 214 of FIG. 2, and the phase-cut circuit 314 of FIG. 3 operate in conjunction with the controller 112 and the wireless interface device 102 in a manner described above. Integrating the 0-10V circuit 114, the DALI circuit 214, and the phase-cut circuit 314 into the modular wireless lighting control device 400 enables use of a single device with different types of drivers/ballasts of light fixtures.

When the modular wireless lighting control device 400 is coupled to a 0-10V driver/ballast or to a DALI driver of a light fixture, the phase-cut output of the phase-cut circuit 314 may be configured to output line voltage (e.g., 0 firing angle) to provide power to the 0-10V driver/ballast or to the DALI driver. Alternatively, the input power line (Line) may be provided to the 0-10V driver/ballast or to the DALI driver. When the modular wireless lighting control device 400 is coupled to a phase-cut driver of a light fixture, the phase-cut output of the phase-cut circuit 314 provides power based on the dimming level (e.g., based on the firing angle) controlled by the controller 112, for example, in response to instructions from a wireless user device.

In FIG. 4, some connections between different components of the modular wireless lighting control device 400 are omitted for clarity of illustration. Further, single connections shown in FIG. 4 may represent a single or multiple electrical connections (e.g., wires) as would be understood by a person of ordinary skill in the art. For clarity of illustration, not all components of the modular wireless lighting control device 400 are shown in FIG. 4. Further, in some example embodiments, some components of the wireless interface device 102 may be integrated into a single component. Similarly, some components of the lighting control device 404 may be integrated into a single component. In general but not exclusively, arrows in FIG. 4 may indicate directions of communication and directions of power supply. Voltage level shown in FIG. 4 are for illustration, and in some example embodiments, other voltage levels may be used without departing from the scope of this disclosure.

Figure 5:
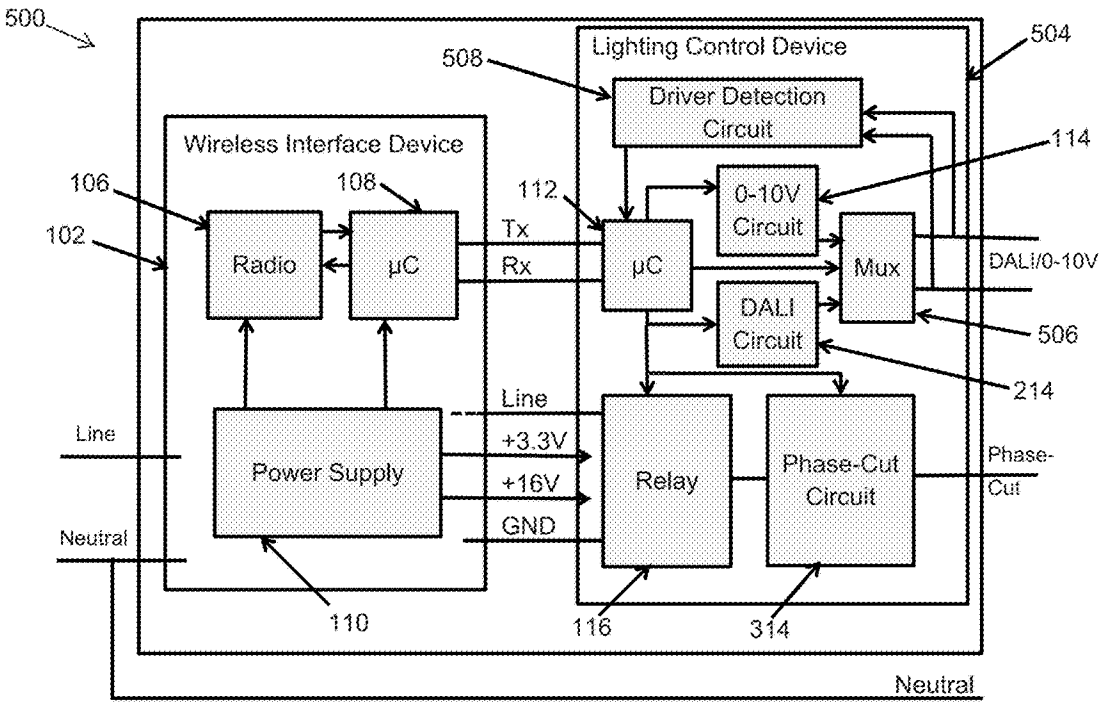
FIG. 5 illustrates a modular wireless lighting control device for use with 0-10V, DALI, and phase-cut drivers according to another example embodiment.

FIG. 5 illustrates a modular wireless lighting control device 500 for use with 0-10V, DALI, and phase-cut drivers according to another example embodiment. In some example embodiments, the modular wireless lighting control device 500 may be coupled to a driver/ballast that provides power to a light fixture and/or allows dimming and other control over the light fixture. For the sake of brevity, description of some elements of the modular wireless lighting control device 500 that are described above are omitted here. As illustrated in FIG. 5, the modular wireless lighting control device 500 include the wireless interface device 102 and a lighting control device 504. The wireless interface device 102 is substantially the same wireless interface device 102 of FIGS. 1A, 2, 3, and 4.

In some example embodiments, the lighting control device 504 includes the controller 112, the relay 116, the 0-10V circuit 114 of FIG. 1A, the DALI circuit 214 of FIG. 2, and the phase-cut circuit 314 of FIG. 3. Individually, the 0-10V circuit 114 of FIG. 1A, the DALI circuit 214 of FIG. 2, and the phase-cut circuit 314 of FIG. 3 operate in conjunction with the controller 112 and the wireless interface device 102 in a manner described above. Integrating the 0-10V circuit 114, the DALI circuit 214, and the phase-cut circuit 314 into the modular wireless lighting control device 400 enables use of a single device with different types of drivers/ballasts of light fixtures.

In some example embodiments, the lighting control device 504 includes multiplexer (Mux) 506. The mux 506 multiplexes signals from the 0-10V circuit 114 and the DALI circuit 214 based on a mux selection signal provided to the mux 506 by the controller 112.

In some example embodiments, the lighting control device 504 also include a driver detection circuit 508 that operates in conjunction with the controller 112 to determine the type of driver/ballast of a light fixture that is coupled to the DALI/0-10V and phase-cut outputs of the modular wireless lighting control device 500.

Figure 6:
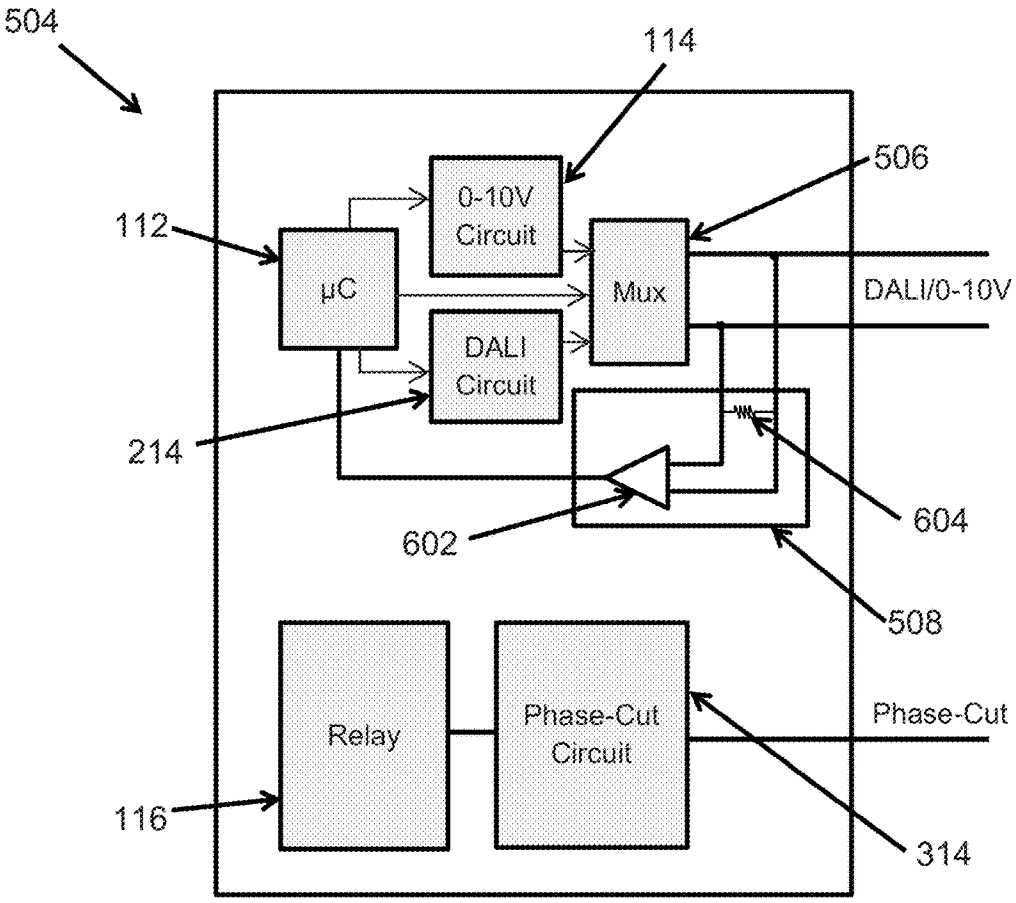
FIG. 6 illustrates the lighting control device of the modular wireless lighting control device of FIG. 5 according to an example embodiment.

FIG. 6 illustrates the lighting control device 504 of the modular wireless lighting control device 500 according to an example embodiment. Referring to FIGS. 5 and 6, inputs of the driver detection circuit 508 are coupled to the DALI/0-10V output lines of the modular wireless lighting control device 500, and the output of the driver detection circuit 508 is coupled to the controller 112. The driver detection circuit 508 includes a comparator 602 and a resistor 604 across the inputs of the comparator. The resistor 604 may have a value large enough for detection of a voltage difference between the DALI/0-10V output lines. The controller 112 may determine whether the type of driver/ballast that attached to the DALI/0-10V output lines based on the output of the comparator 602, for example as described with respect to FIG. 7. In some alternative embodiments, the driver detection circuit 508 may include other components or a different circuit without departing from the scope of this disclosure.

Figure 7:
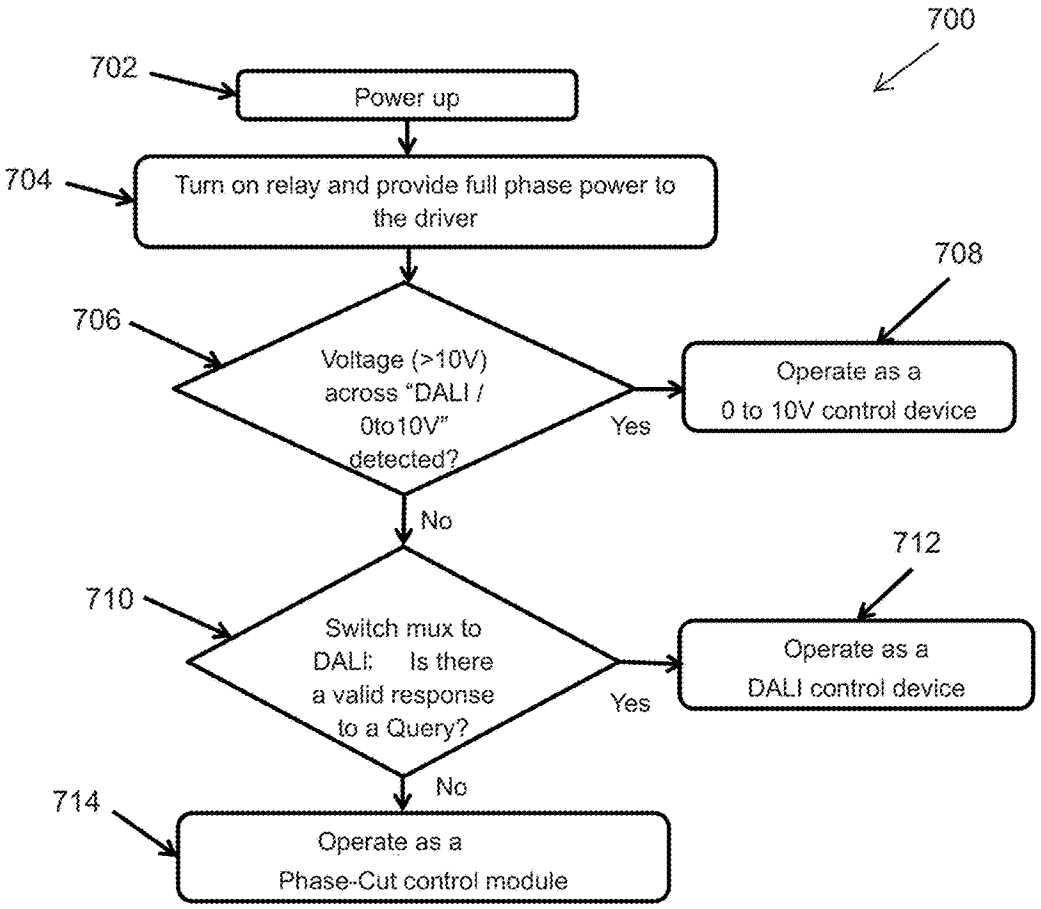
FIG. 7 is a flowchart illustrating a method of detecting the type of driver attached to the modular wireless lighting control device of FIG. 5 according to an example embodiment.

FIG. 7 is a flowchart illustrating a method 700 of detecting the type of driver attached to the modular wireless lighting control device 500 of FIG. 5 according to an example embodiment. Referring to FIGS. 5, 6, and 7, at step 700, the method 700 includes powering up of the lighting control device 504. At step 704, the method 700 includes turning on the relay 116 and providing full phase power to the driver (e.g., the driver of the light fixture 804 of FIG. 8) attached to the modular wireless lighting control device 500. For example, the phase-cut circuit may provide the full phase power to the driver. At step 706, the method 700 includes determining whether the voltage across the DALI/0-10V output lines of the modular wireless lighting control device 500 is higher than 10V. If the voltage across the DALI/0-10V output lines is higher than 10V, the method 700 includes, at step 708, operating as a 0-10V wireless lighting control device. If the voltage across the DALI/0-10V output lines is not higher than 10V, the method 700 includes, at step 710, selecting the signal(s) of the DALI circuit 214 via the mux 506, and performing a query of the driver to check if the driver responds. If the driver provides a valid DALI response, the method 700 includes, at step 712, operating as a DALI wireless lighting control device. If a valid query response is not received at step 710, the method includes, at step 714, operating as a phase-cut wireless lighting control device.

In some example embodiments, the method 700 may include other steps before, after, and/or in between the steps 702-714408. Further, in some alternative embodiments, some of the steps of the method 700 may be performed in a different order than shown in FIG. 7. Although the method 700 is described with respect to 0-10V, DALI, and phase-cut drivers, in alternative embodiments, the method 700 may be used to detect other types of drivers that may be attached to the modular wireless lighting control device 500 with reasonable changes as would be understood by those of ordinary skill in the art.

Figure 8:
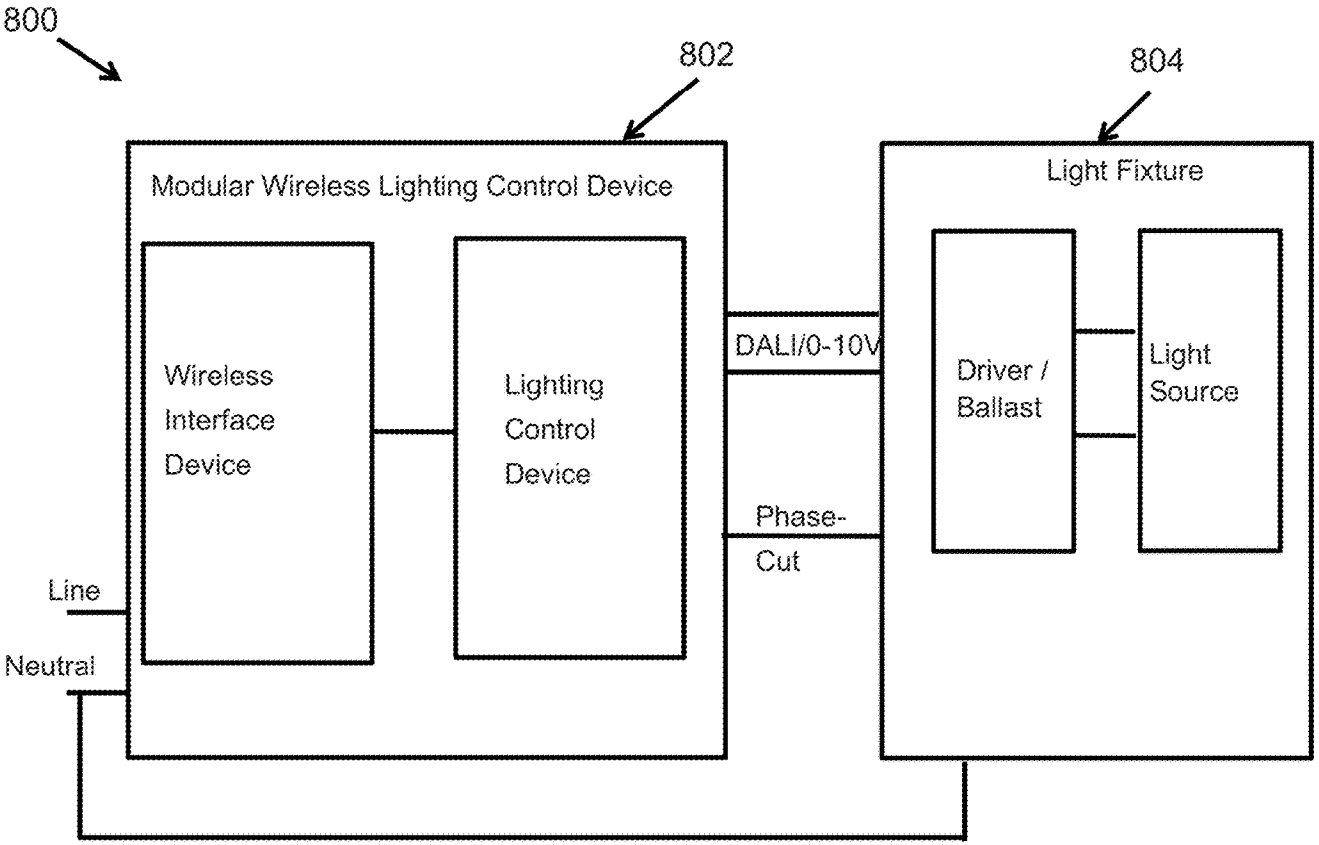
FIG. 8 illustrates a lighting system including a modular wireless lighting control device and a light fixture according to an example embodiment.

FIG. 8 illustrates a lighting system 800 including a modular wireless lighting control device 802 and a light fixture 804 according to an example embodiment. In some example embodiments, the modular wireless lighting control device 802 may be the modular wireless lighting control device 400 or the modular wireless lighting control device 500. In some alternative embodiments, the modular wireless lighting control device 802 may be the modular wireless lighting control device 100, the modular wireless lighting control device 200, or the modular wireless lighting control device 300 with relevant interface connection between the modular wireless lighting control device 802 and the light fixture 804.

As described above, the modular wireless lighting control device 802 may be attached to the light fixture 804 to add wireless control capability to the light fixture 804. A user application on a wireless user device, such as a smart phone, a tablet, a computer, etc., may be used to communicate with the modular wireless lighting control device 802 as described above with respect to the modular wireless lighting control devices 100, 200, 300, 400, and 500. For example, a user may wireless turn on or off, change dim level, etc. of the light fixture 804 via the modular wireless lighting control device 802. A user may also wirelessly obtain status information from the modular wireless lighting control device 802 and the light fixture 804. In general, the driver/ballast of the light fixture may be a 0-10V, DALI, phase-cut, DMX, or another type of driver that is supported by the modular wireless lighting control device 802.

Figure 9:
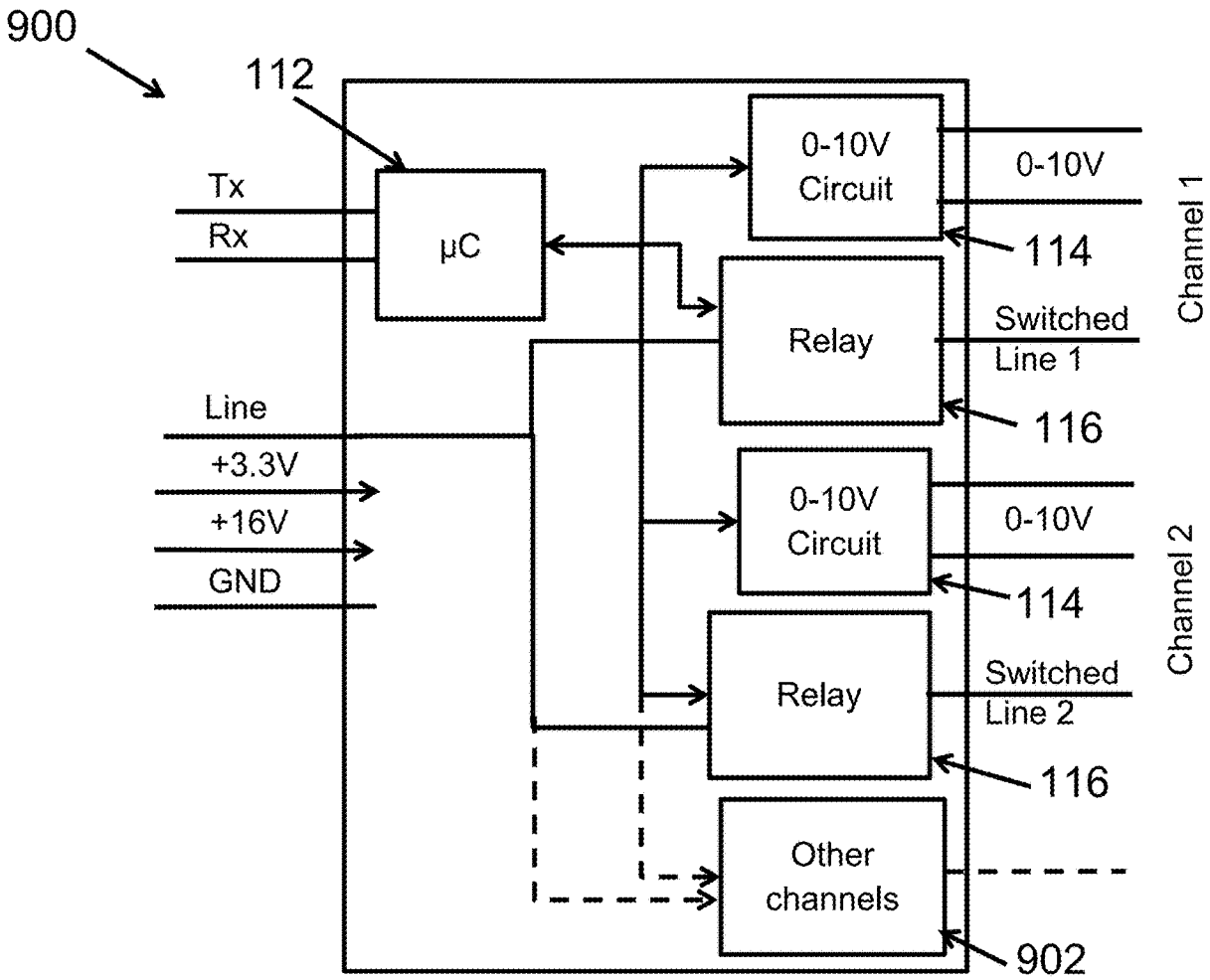
FIG. 9 illustrates a multichannel lighting control device that can be used with the wireless interface device of FIG. 1A according to another example embodiment.

FIG. 9 illustrates a multichannel lighting control device 900 that can be used with the wireless interface device 102 of, for example, FIG. 1A according to another example embodiment. For example, the multichannel lighting control device 900 may be used in place of the lighting control device 104 of FIG. 1A or the lighting control device 404 of FIG. 4. The multichannel lighting control device 900 may be coupled to a driver/ballast that provides power to a light fixture and/or that allows dimming and other control over the light fixture.

In some example embodiments, the lighting control device 900 includes the controller 112, two relays 116, and two 0-10V circuits 114 of FIG. 1A. The controller 112 may be coupled to and operate in conjunction with the controller 108 of the wireless interface device 102 in a manner described above. For example, the Tx and Rx connections may represent UART or other digital interfaces between the controller 112 and the controller 108. Instructions received wirelessly by the wireless interface device 102 of FIG. 1A may be provided to the multichannel lighting control device 900 in a similar manner as described above with respect to, for example, the lighting control device 104 of FIG. 1A. Each 0-10V circuit 114 operates in conjunction with the controller 112 in a similar manner as described above. Power (e.g., 3.3V) may be provided to the controller 112 from the power supply 110 of the wireless interface device 102. Power (e.g., 16V) may be provided to the 0-10V circuit 114 from the power supply 110 of the wireless interface device 102. Each relay 116 operates in conjunction with the controller 112 in a similar manner as described above. The relays 116 may be coupled to the input power line (Line) and may output switched output power on the Switched Line 1 and Switched Line 2 connections.

One 0-10V circuit 114 and one relay 116 may support a first channel (Channel 1), and the other 0-10V circuit 114 and the other relay 116 may support a second channel (Channel 2). To illustrate, the lighting control device 900 may be coupled to one 0-10V light fixture (i.e., a light fixture with a 0-10V diming method) via the Channel 1 interface that includes 0-10V and Switched Line 1 connections and may be coupled to another 0-10V light fixture via the Channel 2 interface that includes 0-10V and Switched Line 2 connections.

In some example embodiments, the lighting control device 900 includes one or more other channel components 902 to support control of additional one or more light fixtures. For example, the channel components 902 may include one or more 0-10V circuits and one or more relays.

For clarity of illustration, not all components of the modular wireless lighting control device 900 are shown in FIG. 9. Some connections between different components of the modular wireless lighting control device 900 are also omitted for clarity of illustration. Further, single connections shown in FIG. 9 may represent a single or multiple electrical connections (e.g., wires) as would be understood by a person of ordinary skill in the art. In general but not exclusively, arrows in FIG. 9 may indicate directions of communication and directions of power supply. Voltage levels shown in FIG. 9 are for illustration, and in some example embodiments, other voltage levels may be used without departing from the scope of this disclosure.

Figure 10:
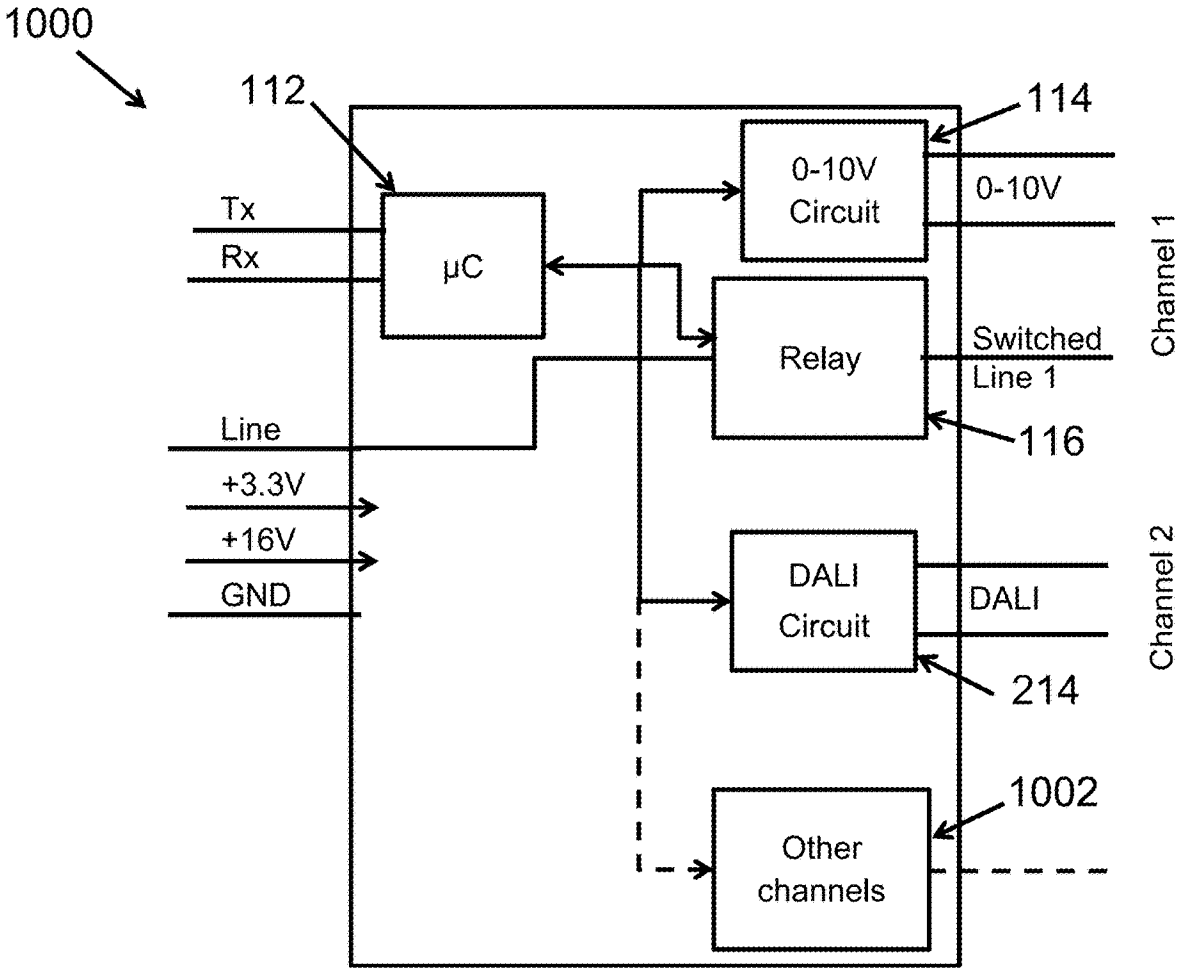
FIG. 10 illustrates a multichannel lighting control device that can be used with the wireless interface device of FIG. 1A according to another example embodiment.

FIG. 10 illustrates a multichannel lighting control device that can be used with the wireless interface device of, for example, FIG. 1A according to another example embodiment. For example, the multichannel lighting control device 1000 may be used in place of the lighting control device 104 of FIG. 1A or the lighting control device 404 of FIG. 4. The multichannel lighting control device 1000 may be coupled to a driver/ballast that provides power to a light fixture and/or that allows dimming and other control over the light fixture.

In some example embodiments, the lighting control device 91000 includes the controller 112, a relay 116, ad a 0-10V circuit 114, and a DALI circuit 214. The controller 112 may be coupled to and operate in conjunction with the controller 108 of the wireless interface device 102 in a manner described above. For example, the Tx and Rx connections may represent UART or other digital interfaces between the controller 112 and the controller 108. Instructions received wirelessly by the wireless interface device 102 of FIG. 1A may be provided to the multichannel lighting control device 1000 in a similar manner as described above with respect to, for example, the lighting control device 104 of FIG. 1A. The 0-10V circuit 114 and the DALI circuit 214 individually operate in conjunction with the controller 112 in a similar manner as described above. Power (e.g., 3.3V) may be provided to the controller 112 from the power supply 110 of the wireless interface device 102. Power (e.g., 16V) may be provided to the DALI circuit 214 from the power supply 110 of the wireless interface device 102. The relay 116 operates in conjunction with the controller 112 in a similar manner as described above. The relay 116 may be coupled to the input power line (Line) and may output switched output power on the Switched Line 1 and Switched Line 2 connections.

One 0-10V circuit 114 and one relay 116 may support a first channel (Channel 1), and the other 0-10V circuit 114 and the other relay 116 may support a second channel (Channel 2). To illustrate, the lighting control device 900 may be coupled to one 0-10V light fixture (i.e., a light fixture with a 0-10V diming method) via the Channel 1 interface that includes 0-10V and Switched Line 1 connections and may be coupled to another DALI light fixture (i.e., a light fixture with a DALI diming method) via the Channel 2 interface that includes DALI and Switched Line 2 connections.

In some example embodiments, the lighting control device 1000 includes one or more other channel components 1002 to support control of additional one or more light fixtures. For example, the channel components 1002 may include one or more control interface circuits such as another 0-10V circuit, a DMX512 circuit, another DALI circuit, a phase-cut circuit, and/or PWM circuit.

For clarity of illustration, not all components of the modular wireless lighting control device 1000 are shown in FIG. 10. Some connections between different components of the modular wireless lighting control device 1000 are also omitted for clarity of illustration. Further, single connections shown in FIG. 10 may represent a single or multiple electrical connections (e.g., wires) as would be understood by a person of ordinary skill in the art. In general but not exclusively, arrows in FIG. 10 may indicate directions of communication and directions of power supply. Voltage levels shown in FIG. 10 are for illustration, and in some example embodiments, other voltage levels may be used without departing from the scope of this disclosure.

Figure 11:
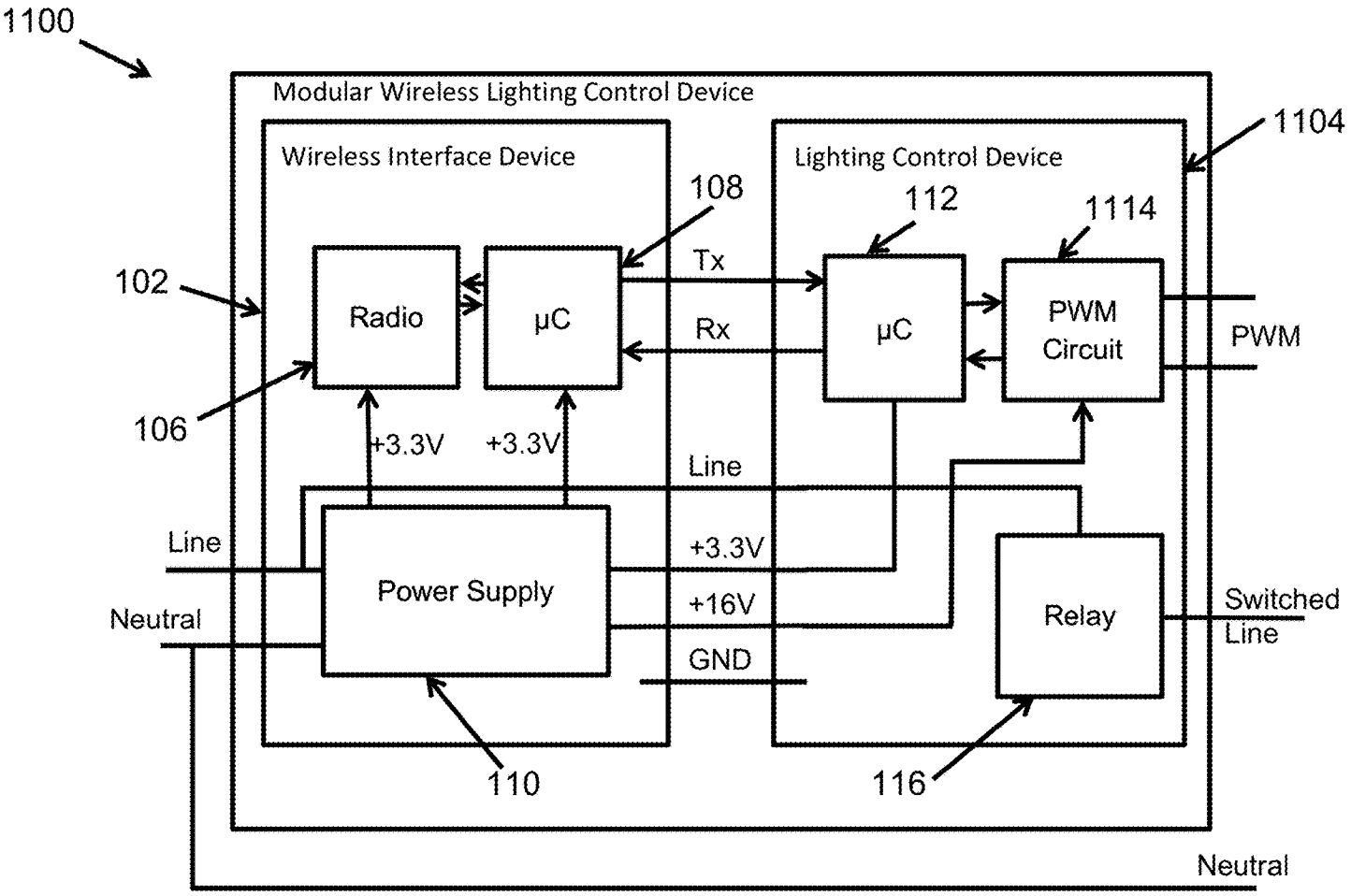
FIG. 11 illustrates a modular wireless lighting control device for use with a PWM driver according to an example embodiment.

FIG. 11 illustrates a modular wireless lighting control device 1100 for use with a PWM driver according to an example embodiment. In some example embodiments, the modular wireless lighting control device 1100 may be coupled to a driver/ballast that provides power to a light fixture and/or allows dimming and other control over the light fixture. For the sake brevity, descriptions of some elements of the modular wireless lighting control device 1100 that are described above are omitted here. As illustrated in FIG. 4, the modular wireless lighting control device 1100 include the wireless interface device 102 and a lighting control device 1104. The wireless interface device 102 is substantially the same wireless interface device 102 of FIG. 1A.

The lighting control device 1104 may include the controller 112, the relay 116, and a pulse width modulation (PWM) circuit 1114. In some example embodiments, the controller 112 is in electrical communication with the PWM circuit 1114 and the relay 116. The controller 112 is substantially the same controller 112 of FIG. 1A and operates in substantially the same manner. The relay 116 is also substantially the same relay 116 of FIG. 1A. As illustrated in FIG. 11, the power supply 110 of the wireless interface device 102 provides power (e.g., +3.3 V) to the controller 112 and provides power (+16V) to the relay 116.

The relay 116 may be electrically switched on and off by the controller 112 as described above. To illustrate, the relay 116 is coupled to the same input power line (Line) that is coupled to the power supply 110. An output power line (Switched Line) of the relay 116 is provided to connect to a light fixture, and the relay 116 may serve as a switch to turn on and off power to the light fixture. The PWM circuit 1114, which is control interface circuitry of the lighting control device 1104, is compatible with a PWM driver that is commonly used in light fixtures.

In some example embodiments, the controller 112 controls the output of the PWM circuit 1114. For example, the controller 112 may control the output signal from the PWM circuit 1114. The firing angle may ideally range from 0 to 180 degrees. In some example embodiments, the firing angle may range between 30 and 150 degrees. The controller 212 may control the phase-cut circuit 314 (e.g., change firing angle) based on instructions that are received wirelessly by the modular wireless lighting control device 300. To illustrate, the transceiver 106 may receive a signal including one or more instructions (e.g., dim level, turn off, etc.), and the controller 108 may extract and provide the instruction(s) to the controller 112 of the lighting control device 304.

In general, the controller 112 may process instructions received from the wireless interface device 102 in a similar manner as described with respect to FIG. 1A to control a PWM driver of a light fixture that is attached to the modular wireless lighting control device 1100. In general, the wireless interface device 102 and the lighting control device 1104 may communicate with each other to provide wireless control over a PWM driver of a light fixture that is attached to the lighting control device 304. To illustrate, instructions received by the wireless interface device 102 may be used to configure the modular wireless lighting control device 1100, to request status and other information from the modular wireless lighting control device 1100, and to control (e.g., change dim level) of the PWM driver of a light fixture that is attached to the modular wireless lighting control device 300. In some example embodiments, dim levels and other status information may be provided by the modular wireless lighting control device 1100 to a wireless user device by wirelessly transmitting the information.

In some example embodiments, the wireless interface device 102 may query the lighting control device 1104 to determine the identity of the lighting control device 1104. For example, at power up, the wireless interface device 102 may query the lighting control device 1104 to determine whether the lighting control device 11104 is compatible with a PWM driver or with another type of driver/ballast. To illustrate, the wireless interface device 102 may query the lighting control device 1104 via the Tx connection and receive the response via the Rx connection.

By adding the modular wireless lighting control device 1100 to a light fixture that has a PWM driver, the modular wireless lighting control device 1100 may be used to add wireless control capability to the light fixture. By adding the wireless control capability to a light fixture, more costly replacement of the entire light fixture or the light source of the light fixture with a wireless capable lighting module may be avoided. In some example embodiments, the modular wireless lighting control device 1100 may be added to a light fixture during the manufacturing/assembly of the light fixture. Alternatively, the modular wireless lighting control device 1100 may be added to the light fixture by an end user.

In FIG. 11, some connections between different components of the modular wireless lighting control device 1100 are omitted for clarity of illustration. Further, single connections shown in FIG. 11 may represent single or multiple electrical connections (e.g., wires) as would be understood by a person of ordinary skill in the art. For clarity of illustration, not all components of the modular wireless lighting control device 1100 are shown in FIG. 11. Further, in some example embodiments, some components of the wireless interface device 102 may be integrated into a single component. Similarly, some components of the lighting control device 1104 may be integrated into a single component. In general but not exclusively, arrows in FIG. 11 may indicate directions of communication and directions of power supply. Voltage level shown in FIG. 11 are for illustration, and in some example embodiments, other voltage levels may be used without departing from the scope of this disclosure.

Figure 12:
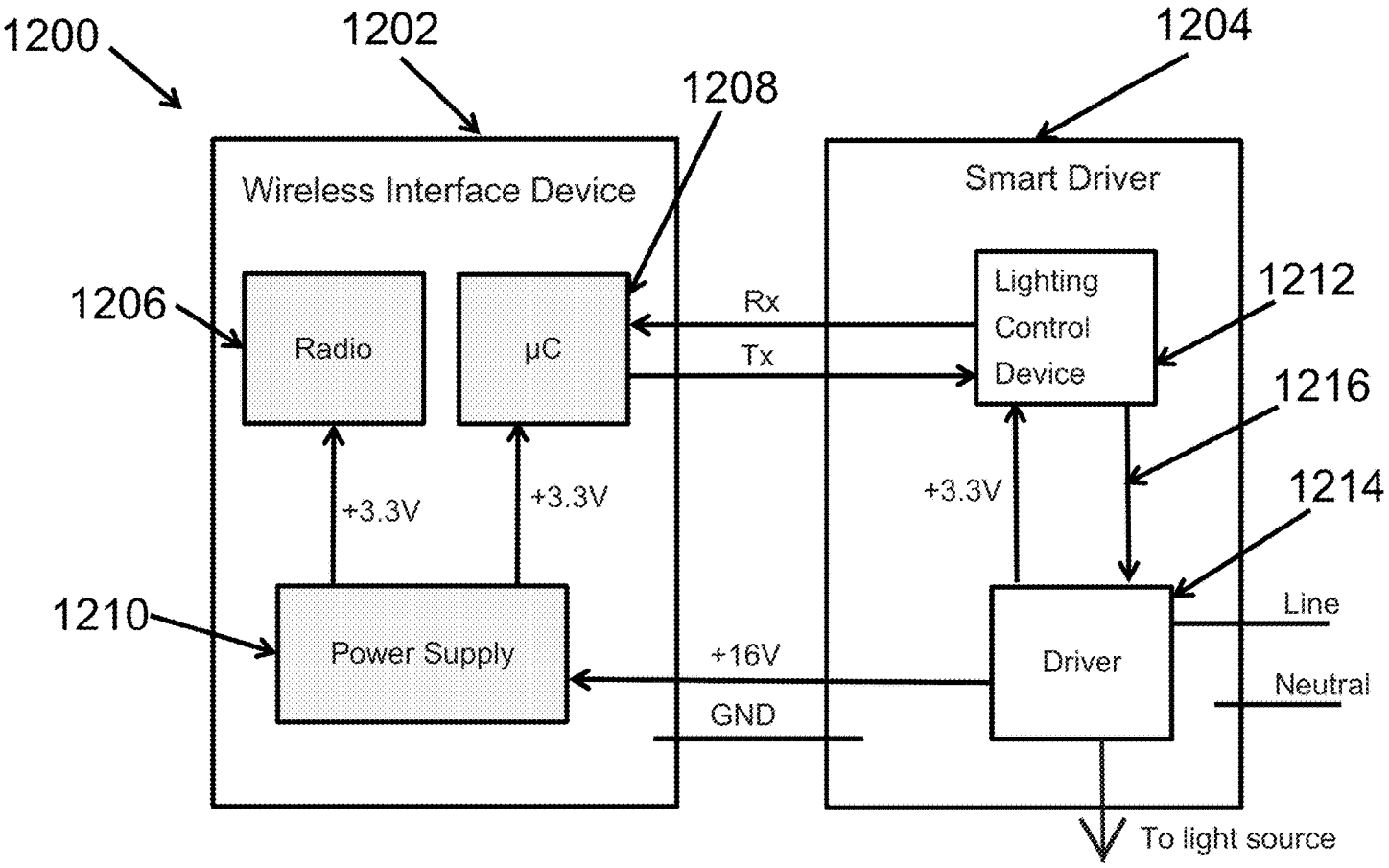
FIG. 12 illustrates a modular wireless lighting control device with an integrated driver according to an example embodiment.

FIG. 12 illustrates a modular wireless lighting control device 1200 with an integrated driver according to an example embodiment. The modular wireless lighting control device 1200 includes a wireless interface device 1202 and a smart driver 1204. The wireless interface device 1202 includes a wireless transceiver (radio) 1206, a controller 1208, and power supply 1210. The smart driver 1204 includes a lighting control device 1212 and a driver 1214. An input power line (Line) is coupled to the driver 1214, and the driver 1214 provides power (e.g., +3.3V) to the lighting control device 1212. The driver 1214 also provides power (e.g., +16V) to the power supply 1210 of the wireless interface device 1202. In some example embodiments, the power supply 1210 provide power (e.g., +3.3V) to the transceiver 1206 and to the controller 1208.

In some example embodiments, the lighting control device 1212 may correspond to the lighting control device 104, 204, 404, 504 described above. For example, the lighting control device 1212 may interface and control the driver 1214, which may be a 0-10V, a DALI, a phase-cut, or another driver that is compatible with the lighting control device 1212. Connection 1216 represents the appropriate interface between the lighting control device 1212 and the driver 1214.

In some example embodiments, the transceiver 1206 may correspond to the transceiver 106 described above. Further, the controller 1208 may correspond to the controller 108 of the wireless interface device 102 described above and may communicate with the lighting control device 1212 in a similar manner. To illustrate, instructions from a user application running on a wireless user device may be wirelessly provided to the wireless interface device 1202 in a similar manner as described above with respect to the wireless interface device 102. The received instructions may be provided to the lighting control device 1212 of the smart driver 1204, for example, via the Tx connection (e.g., a UART connection). The lighting control device 1212 may control (e.g., turn on or off, etc.) the driver based on the instructions. In some example embodiments, the lighting control device 1212 may provide information, such as status information, to the wireless interface device 1202 via the Rx connection (e.g., a UART connection). In turn, the wireless interface device 1202 may wirelessly transmit the information to a wireless user device.

In some example embodiments, the wireless interface device 1202 may be plugged into each other and add wireless control capability to light fixture. In FIG. 12, some connections between different components of the modular wireless lighting control device 1200 are omitted for clarity of illustration. Further, single connections shown in FIG. 12 may represent single or multiple electrical connections (e.g., wires) as would be understood by a person of ordinary skill in the art. For clarity of illustration, not all components of the modular wireless lighting control device 1200 are shown in FIG. 12. Further, in some example embodiments, some components of the wireless interface device 1202 may be integrated into a single component. Similarly, some components of the smart driver 1204 may be integrated into a single component. In general but not exclusively, arrows in FIG. 12 may indicate directions of communication and directions of power supply. Voltage level shown in FIG. 12 are for illustration, and in some example embodiments, other voltage levels may be used without departing from the scope of this disclosure.

Figure 13:
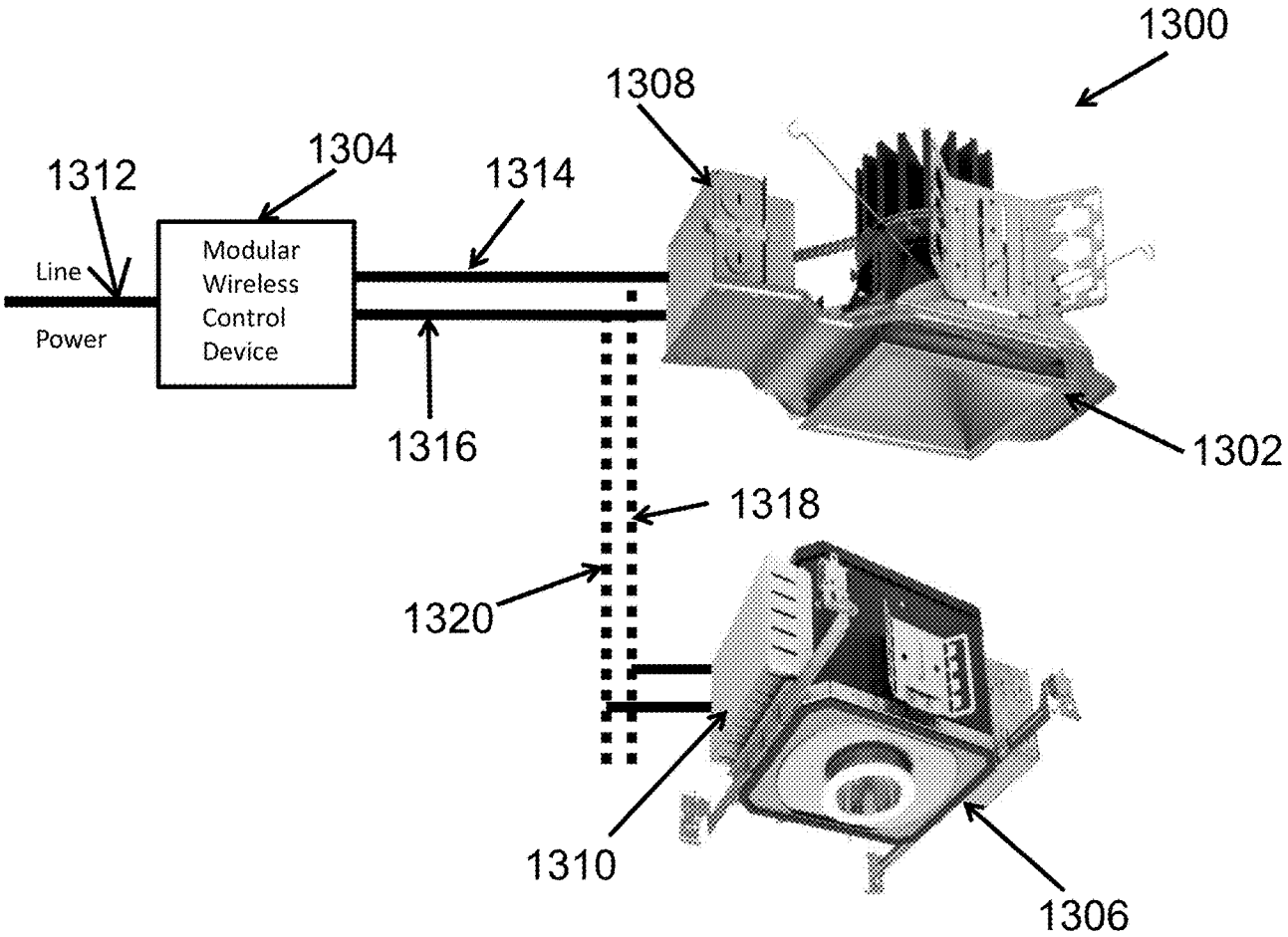
FIG. 13 illustrates a lighting system including a modular wireless lighting control device and light fixtures according to another example embodiment.

FIG. 13 illustrates a lighting system 1300 including a modular wireless lighting control device 1304 and light fixtures 1302, 1306 according to another example embodiment. In some example embodiments, the modular wireless lighting control device 1304 receives line power via a connection (e.g., wires) 1312. The modular wireless lighting control device 1304 is coupled to the first light fixture 1302 via connections 1314, 1316. For example, the connection 1314 may include one or more wires for dim control of the light fixture 1302, and the connection 1316 may include one or more wires for providing switched power to the light fixture 1302. The light fixture 1302 may include a driver that is positioned in a junction box 1308 of the light fixture 1302, and the connections 1314, 1316 may be coupled to the driver.

The modular wireless lighting control device 1304 enables wireless control (e.g., turning on or off and dim level adjustment) of the light fixture 1302. In some example embodiments, the modular wireless lighting control device 1304 may be the modular wireless lighting control device 100 of FIG. 1A, the modular wireless lighting control device 400 of FIG. 4, the modular wireless lighting control device 500 of FIG. 5, the modular wireless lighting control device 900 of FIG. 9, the modular wireless lighting control device 1000 of FIG. 10, or the modular wireless lighting control device 1100 of FIG. 11.

In some example embodiments, the modular wireless lighting control device 1304 may also be coupled to the second light fixture 1306 via the connections 1314, 1316. To illustrate, the connection 1314 may be extended to the second light fixture 1306 via a connection 1318 that may include one or more wires. The connection 1316 may also be extended to the second light fixture 1306 via a connection 1320 that may include one or more wires. For example, the connections 1318, 1320 may be coupled to a driver 1310 of the light fixture 1306. Thus, the modular wireless lighting control device 1304 may enable wireless control (e.g., turn on or off, change dim level, etc.) of one or more light fixtures using a single output channel that includes, for example, a dim level control output (e.g., 0-10V output) and a switched power output (e.g., from a relay that receives a mains power).

In some alternative embodiments, the connection 1316 may be used to provide the mains power (i.e., not switched power) to the light fixture 1302, 1304. For example, the line power provided to the modular wireless lighting control device 1304 may be passed through the modular wireless lighting control device 1304 and provided the light fixtures 1302, 1306 via the connection 1316. For example, the modular wireless lighting control device 1304 may be the modular wireless lighting control device 200 of FIG. 2. Further, in some example embodiments, the connection 1316 may be used to provide power as well as for dim control of the light fixtures 1302, 1306. For example, the modular wireless lighting control device 1304 may be the modular wireless lighting control device 300 of FIG. 3, where the phase-cut output of the modular wireless lighting control device 300 is coupled to the connection 1316.

Although two light fixtures are shown in the system 1300 of FIG. 13, in some example embodiments, the modular wireless lighting control device 1304 may be coupled to just one or more than two light fixtures.

Figure 14:
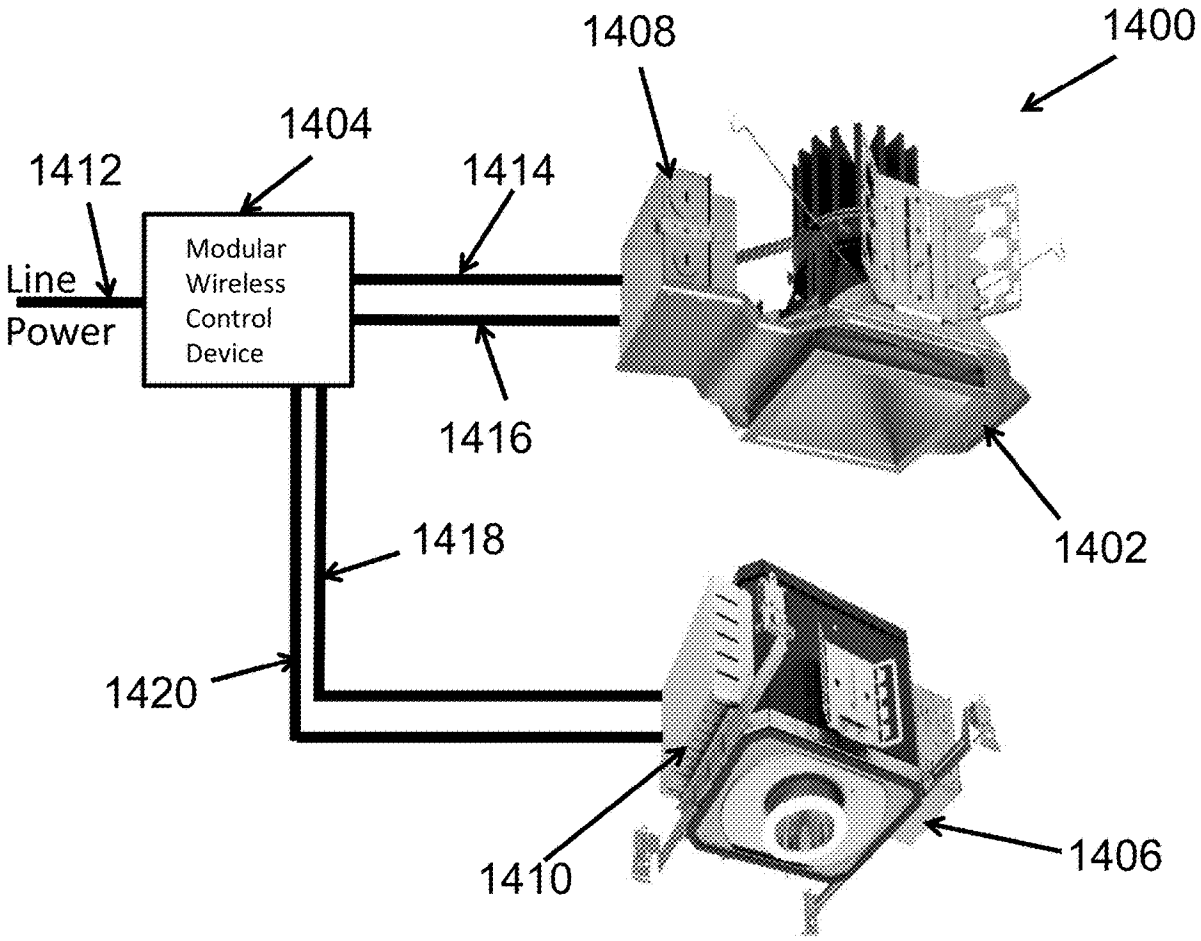
FIG. 14 illustrates a lighting system including a modular wireless lighting control device and light fixtures according to another example embodiment.

FIG. 14 illustrates a lighting system 1400 including a modular wireless lighting control device 1404 and light fixtures 1402, 1404 according to another example embodiment. In some example embodiments, the modular wireless lighting control device 1404 receives line power via a connection (e.g., wires) 1412. The modular wireless lighting control device 1404 is coupled to the first light fixture 1402 via connections 1414, 1416. For example, the connection 1414 may include one or more wires for dim control of the light fixture 1402, and the connection 1416 may include one or more wires for providing switched power to the light fixture 1402. The light fixture 1402 may include a driver that is positioned in a junction box 1408 of the light fixture 1402, and the connections 1414, 1416 may be coupled to the driver.

In some example embodiments, the modular wireless lighting control device 1404 may also be coupled to the second light fixture 1406 via the connections 1418, 1420. For example, the connections 1418, 1420 may be coupled to a driver 1410 of the light fixture 1406. The connection 1418 may include one or more wires for dim control of the light fixture 1406, and the connection 1420 may include one or more wires for providing switched power to the light fixture 1406. Thus, the modular wireless lighting control device 1404 may enable wireless control (e.g., turn on or off, change dim level, etc.) of one light fixture using one output channel and enable wireless control of another light fixture using another output channel. For example, each output channel may include, for example, a dim level control output (e.g., 0-10V output, DALI, phase-cut, PWM, DMX512, etc.) and a power output (switched or pass-through). In some example embodiments, the connections 1414, 1416 may be coupled to more than one light fixture, and the connections 1418, 1420 may also be coupled to more than one light fixture.

The modular wireless lighting control device 1404 enables wireless control (e.g., turning on or off and dim level adjustment) of the light fixtures 1402, 1406. In some example embodiments, the modular wireless lighting control device 1404 may be the modular wireless lighting control device 400 of FIG. 4, the modular wireless lighting control device 500 of FIG. 5, the modular wireless lighting control device 900 of FIG. 9, or the modular wireless lighting control device 1000 of FIG. 10.

Although two light fixtures are shown in the system 1400 of FIG. 14, in some example embodiments, the modular wireless lighting control device 1404 may be coupled to just one or more than two light fixtures.

Figure 15:
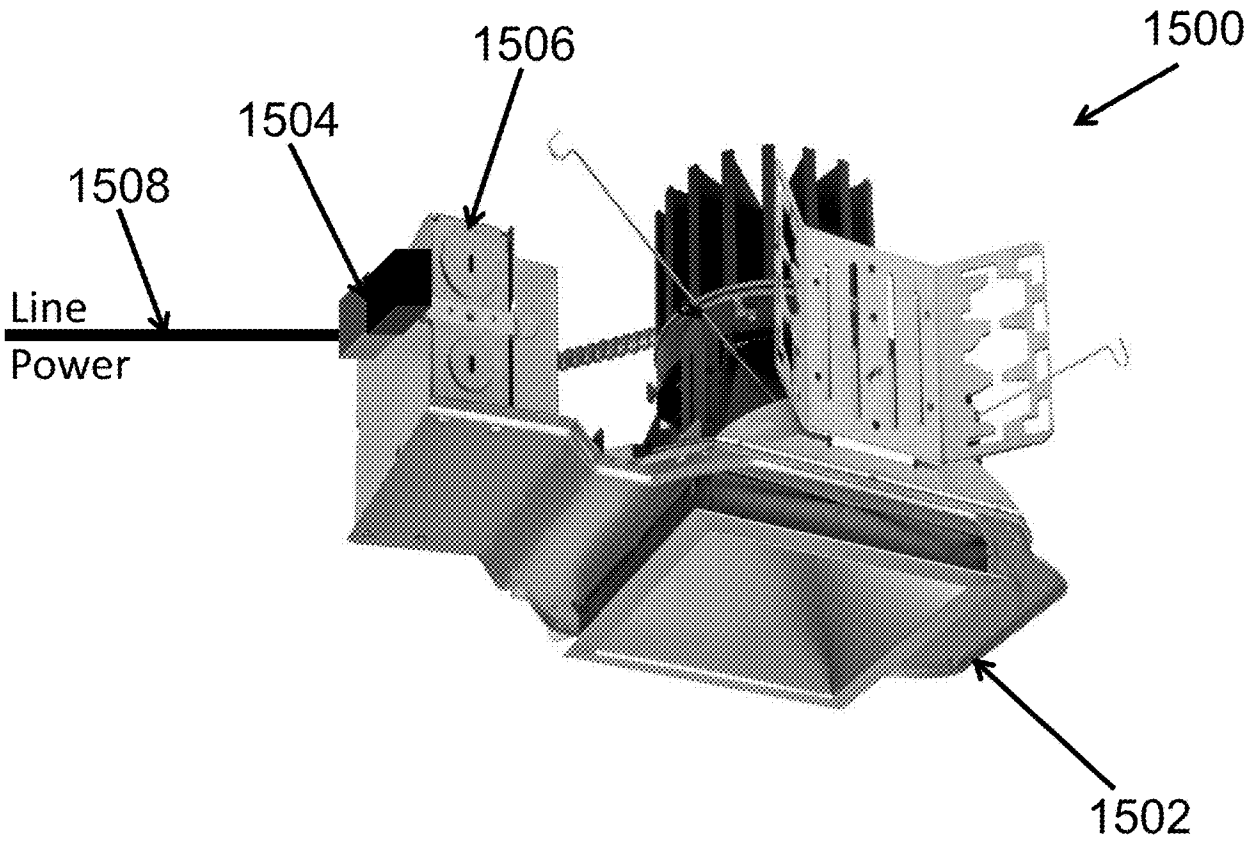
FIG. 15 illustrates a lighting system including a modular wireless lighting control device attached to a light fixture according to an example embodiment.

FIG. 15 illustrates a lighting system 1500 including a modular wireless lighting control device 1504 attached to a light fixture 1502 according to an example embodiment. As illustrated in FIG. 15, the modular wireless lighting control device 1504 is attached to a junction box 1506 of the light fixture 1502. The modular wireless lighting control device 1504 may be coupled to a connection 1508 that is used to provide line power (e.g., mains power) to the modular wireless lighting control device 1504. To illustrate, a driver of the light fixture 1502 may be located inside the junction box 1506, and the modular wireless lighting control device 1504 may be in electrical communication with the driver to control (e.g., turn on or off or adjust dim level) of the light fixture 1502. For example, the modular wireless lighting control device 1504 may be the modular wireless lighting control device 1304 of FIG. 13 or the modular wireless lighting control device 1404 of FIG. 14. In some alternative embodiments, the light fixture 1502 that may not include a driver (e.g., an LED driver) or a ballast for providing power to the light source of the light fixture 1502, and the modular wireless lighting control device 1504 may still be compatible with the light fixture 1502.

Although one light fixture is shown in FIG. 15, in some alternative embodiments, the system 1500 may include more than one light fixtures. The particular fixture shown in FIG. 15 is for illustrative purpose, and the system 1500 may include other types of light fixtures without departing from the scope of this disclosure.

Figure 16:
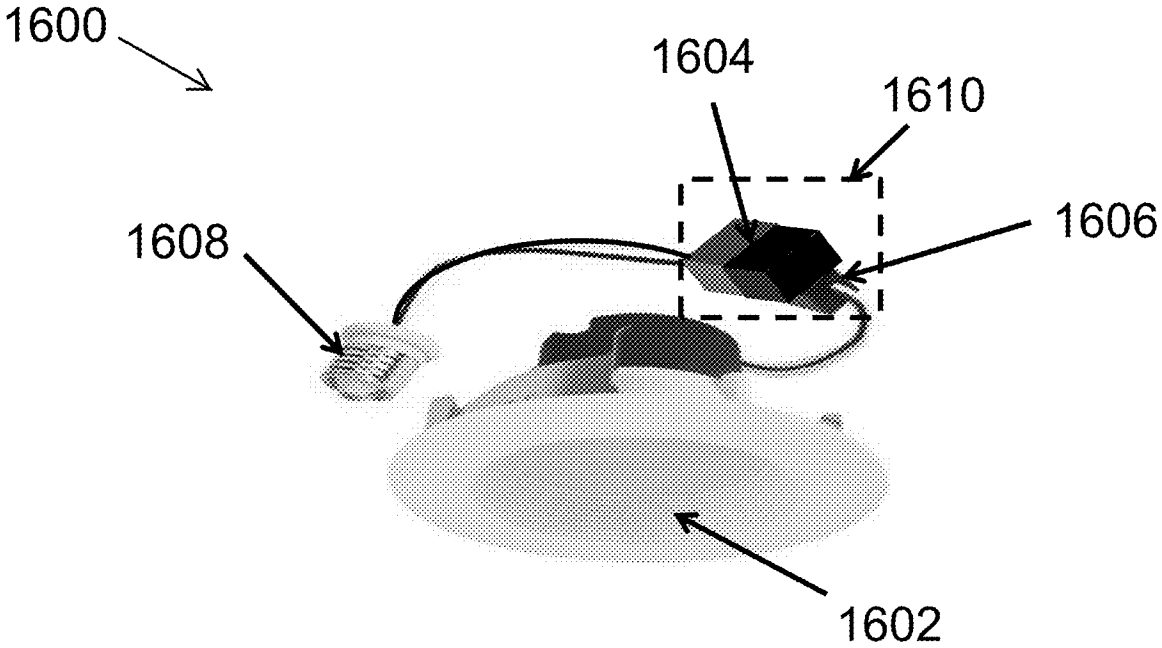
FIG. 16 illustrates a lighting system including a modular wireless lighting control device and a light fixture according to another example embodiment.

FIG. 16 illustrates a lighting system 1600 including a modular wireless lighting control device 1604 and a light fixture 1602 according to another example embodiment. As illustrated in FIG. 16, the system 1600 includes the light fixture 1602, a splice box 1606, and a connector 1608 that is used to provide line power. The modular wireless lighting control device 1604 is attached to the splice box 1606. The modular wireless lighting control device 1604 may be the modular wireless lighting control device 1304 of FIG. 13 or the modular wireless lighting control device 1404 of FIG. 14. In some example embodiments, the modular wireless lighting control device 1604 and the splice box 1606 may be integrated into a single device 1610. By including the modular wireless lighting control device 1604 in the system 1600, the light fixture 1602 may be wirelessly controlled as described above.

Although one light fixture is shown in FIG. 16, in some alternative embodiments, the system 1600 may include more than one light fixtures.

Figure 17:
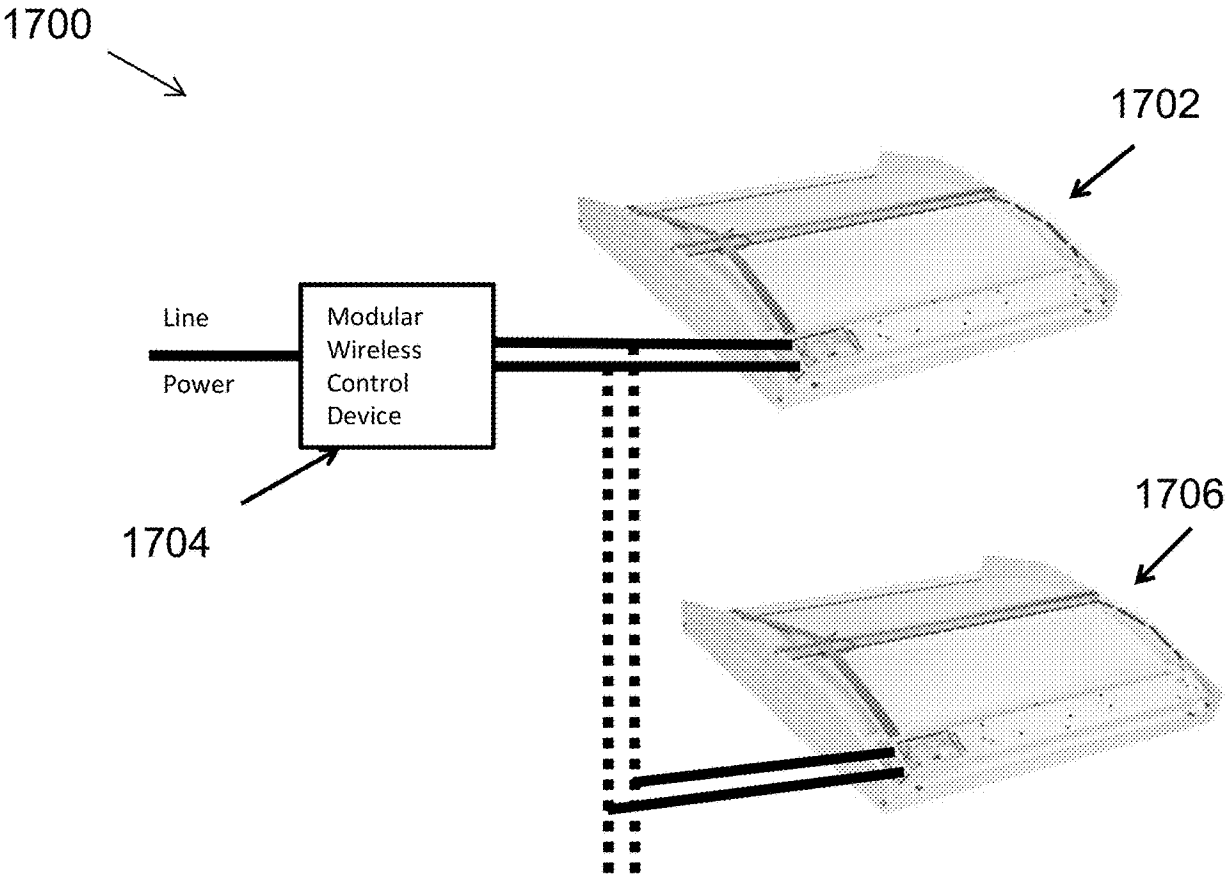
FIG. 17 illustrates a lighting system including a modular wireless lighting control device and light fixtures according to another example embodiment.

FIG. 17 illustrates a lighting system 1700 including a modular wireless lighting control device 1704 and light fixtures 1702, 1706 according to another example embodiment. As illustrated in FIG. 17, the modular wireless lighting control device 1704 receives line power (e.g., mains power) and can provide a switched power and a control signal (e.g., dim control) to the light fixture 1702. In some example embodiments, the modular wireless lighting control device 1704 can also provide the switched power and the control signal to the light fixture 1706. The modular wireless lighting control device 1704 may be the modular wireless lighting control device 1304 of FIG. 13 or the modular wireless lighting control device 1404 of FIG. 14. For example, the system 1700 may be operated in a similar manner as described with respect to the system 1300 of FIG. 13. By including the modular wireless lighting control device 1704 in the system 1700, the light fixtures 1702, 1706 may be wirelessly controlled as described above.

Although two light fixtures are shown in FIG. 17, in some alternative embodiments, the system 1700 may include fewer or more than two light fixtures.

Figure 18:
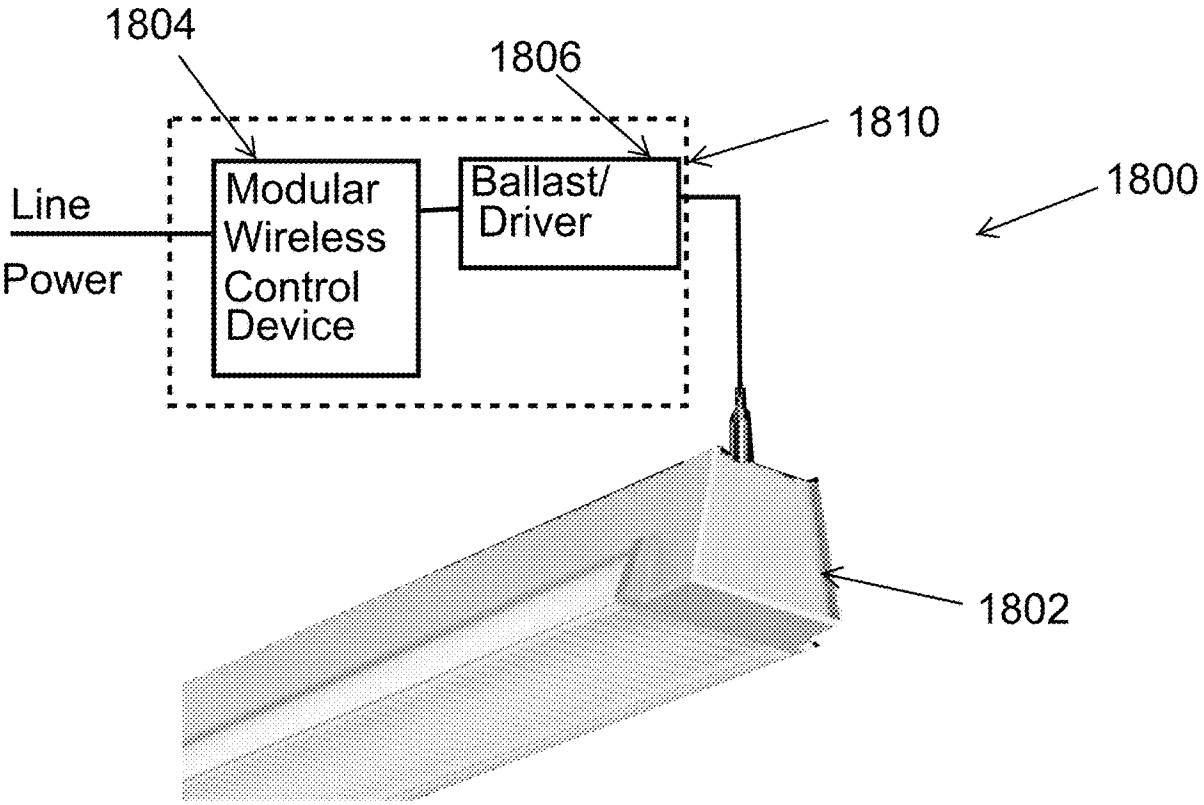
FIG. 18 illustrates a lighting system including a modular wireless lighting control device and a light fixture according to another example embodiment.

FIG. 18 illustrates a lighting system 1800 including a modular wireless lighting control device 1804 and a light fixture 1802 according to another example embodiment. As illustrated FIG. 18, the system 1800 includes the light fixture 1802, a ballast/driver 1806, and the modular wireless lighting control device 1804. The modular wireless lighting control device 1804 receives line power (e.g., mains power) and can provide a switched power and a control signal (e.g., dim control) to the light fixture 1802, which may be a suspended light fixture. The modular wireless lighting control device 1804 may be the modular wireless lighting control device 1304 of FIG. 13 or the modular wireless lighting control device 1404 of FIG. 14. For example, the system 1800 may be operated in a similar manner as described with respect to the system 1300 of FIG. 13. In some example embodiments, the modular wireless lighting control device 1804 and the ballast/driver 1806 may be integrated into a single device 1810. By including the modular wireless lighting control device 1804 in the system 1800, the light fixture 1802 may be wirelessly controlled as described above.

Although one light fixture is shown in FIG. 18, in some alternative embodiments, the system 1800 may include more than one light fixtures.

Although particular embodiments have been described herein in detail, the descriptions are by way of example. The features of the example embodiments described herein are representative and, in alternative embodiments, certain features, elements, and/or steps may be added or omitted. Additionally, modifications to aspects of the example embodiments described herein may be made by those skilled in the art without departing from the spirit and scope of the following claims, the scope of which are to be accorded the broadest interpretation so as to encompass modifications and equivalent structures.

What is claimed is:

1. A wireless lighting control device, the device comprising:

a wireless interface device comprising a wireless transceiver and a first controller, wherein the wireless transceiver is in electrical communication with the first controller, the wireless interface device to receive lighting control instructions wirelessly via the wireless transceiver;

a lighting control device in electrical communication with the wireless interface device, the lighting control device comprising a second controller, a first control interface circuitry, and a second control interface circuitry; and a driver detection circuitry, wherein the second controller and the driver detection circuitry determine a type of a driver of a light fixture that is coupled to an output port of the wireless lighting control device, wherein a first one or more dim control signals generated by the first control interface circuitry or a second one or more dim control signals generated by the second control interface circuitry are provided to the driver through the output port of the wireless lighting control device based on the type of the driver.

2. The wireless lighting control device of claim 1, further comprising a relay coupled to an input power line and an output power line, wherein the second controller controls the relay to turn on and off power on the output power line.

3. The wireless lighting control device of claim 2, further comprising a third control interface circuitry compatible with a phase-cut driver and wherein the output power line is coupled to the third control interface circuitry.

4. The wireless lighting control device of claim 2, wherein the first control interface circuitry is compatible with a 0-10 volt light fixture and wherein the second control interface circuitry is compatible with a digitally addressable lighting interface (DALI) light fixture.

5. The wireless lighting control device of claim 1, further comprising a power supply that receives AC power and provides a first voltage to the first controller and a second voltage to the first control interface circuitry, wherein the first voltage is different from the second voltage.

6. The wireless lighting control device of claim 1, wherein the second controller and the driver detection circuitry are configured to determine whether the type of the driver is 0-10V, DALI, or phase-cut.

7. The wireless lighting control device of claim 6, wherein, upon determining that the type of the driver is other than 0-10V, the second controller is to determine whether the type of the driver is DALI-type based on a DALI query sent to the driver.

8. The wireless lighting control device of claim 1, wherein the wireless interface device is compliant with one or more of IEEE 802.11, Bluetooth, and Zigbee wireless standards.

9. The wireless lighting control device of claim 1, wherein the wireless interface device wirelessly transmits status information provided by the lighting control device.

10. The wireless lighting control device of claim 1, wherein the lighting control device translates the lighting control instructions into light fixture compatible instructions.

11. A wireless lighting control device, the device comprising:

a wireless interface device comprising a wireless transceiver and a first controller, wherein the wireless transceiver is in electrical communication with the first controller, the wireless interface device to receive lighting control instructions wirelessly via the wireless transceiver;

a lighting control device in electrical communication with the wireless interface device, the lighting control device comprising a second controller, a first control interface circuitry compatible with a 0-10V driver, a second control interface circuitry compatible with a DALI driver, and a third control interface circuitry compatible with a phase-cut driver; and a driver detection circuitry, wherein a first one or more signals generated by the first control interface circuitry, a second one or more signals generated by the second control interface circuitry, or a third one or more signals generated by the third control interface circuitry are provided to a driver coupled to the wireless lighting control device based on a type of the driver determined by the second controller and the driver detection circuitry.

12. The wireless lighting control device of claim 11, wherein the first one or more signals and the second one or more signals are provided to the driver through a first output port of the wireless lighting control device and wherein the third one or more signals are provided to the driver through a second output port of the wireless lighting control device.

13. The wireless lighting control device of claim 11, further comprising a relay coupled to an input power line and to an output power line, wherein the relay provides switched power to the third control interface circuitry over the output power line.

14. The wireless lighting control device of claim 11, wherein, upon determining that the driver is not the 0-10V driver, the second controller determines whether the driver is the DALI driver based on a DALI query sent to the driver.

15. The wireless lighting control device of claim 14, wherein, upon determining that the driver is not the DALI driver, the second controller determines that the driver is the phase-cut driver.

16. A lighting system, comprising:

a light fixture comprising a driver and a light source; and a wireless lighting control device, wherein the driver provides electrical power to the light source, the wireless lighting control device comprising:

a wireless interface device comprising a wireless transceiver and a first controller, wherein the wireless transceiver is in electrical communication with the first controller, the wireless interface device to receive lighting control instructions wirelessly via the wireless transceiver;

a lighting control device in electrical communication with the wireless interface device, the lighting control device comprising a second controller, a first control interface circuitry, and a second control interface circuitry; and a driver detection circuitry, wherein the second controller and the driver detection circuitry determine a type of the driver, wherein a first one or more signals generated by the first control interface circuitry or a second one or more signals generated by the second control interface circuitry are provided to the driver through an output port of the wireless lighting control device based on the type of the driver, and wherein the driver provides the electrical power to the light source based on the first one or more signals or the second one or more signals.

17. The lighting system of claim 16, further comprising a relay coupled to an input power line and an output power line, wherein the second controller controls the relay to turn on and off power on the output power line.

18. The lighting system of claim 17, further comprising a third control interface circuitry that is compatible with a phase-cut driver, wherein the power output line is coupled to the third control interface circuitry.

19. The lighting system of claim 17, wherein the first control interface circuitry is compatible with a 0-10 volt driver.

20. The lighting system of claim 19, wherein the second control interface circuitry is compatible with a DALI driver.

* * * * *